United States Patent [19]

Aono et al.

[11] Patent Number: 4,619,883

[45] Date of Patent: Oct. 28, 1986

[54] DYE FIXING MATERIAL

[75] Inventors: Toshiaki Aono; Koichi Nakamura; Taku Nakamura, all of Kanagawa, Japan

[73] Assignee: Fuji Photo Film Co., Ltd., Kanagawa, Japan

[21] Appl. No.: 677,408

[22] Filed: Dec. 3, 1984

[30] Foreign Application Priority Data

Dec. 1, 1983 [JP] Japan ..... 58-227493

[51] Int. Cl.[4] ..... G03C 5/54; G03C 1/40

[52] U.S. Cl. ..... 430/203; 430/213

[58] Field of Search ..... 430/213, 203

[56] References Cited

U.S. PATENT DOCUMENTS

| | | | |
|---|---|---|---|
| 4,124,386 | 11/1978 | Yoshida et al. | 430/213 |
| 4,273,853 | 6/1981 | Ponticello et al. | 430/213 |
| 4,415,647 | 11/1983 | Klein et al. | 430/213 |
| 4,450,224 | 5/1984 | Klein et al. | 430/213 |
| 4,473,631 | 9/1984 | Hirai et al. | 430/203 |
| 4,483,914 | 11/1984 | Naito et al. | 430/203 |
| 4,500,626 | 2/1985 | Naito et al. | 430/203 |

*Primary Examiner*—Richard L. Schilling

*Attorney, Agent, or Firm*—Sughrue, Mion, Zinn, Macpeak & Seas

[57] ABSTRACT

A dye fixing material for fixing a mobile hydrophilic dye formed imagewise to a dye fixing layer is disclosed. The mobile hydrophilic dye image is formed by heating a heat-developable silver halide light-sensitive material in a substantially anhydrous condition after or during imagewise exposure. At least one layer of the dye fixing material contains a polymer having monomeric units of the following formula wherein A represents a vinyl monomer unit having no imidazole or imidazolium group, $R_1$ and $R_3$ represent a hydrogen atom, an alkyl group, an alkyl group substituted by a group capable of forming a coordinate bond with a metal, or a salt thereof, $R_2$ and $R_5$ represent a hydrogen atom or an alkyl, aralkyl, or aryl group, $R_4$ represents an alkyl or aralkyl group, $X^{\ominus}$ represents an acid radical, x is from 0 to 80 mole %, y is from 10 to 100 mole %, z is from 0 to 50 mole %.

20 Claims, No Drawings

DYE FIXING MATERIAL

FIELD OF THE INVENTION

This invention relates to a dye fixing material for transferring a dye image formed in a heat-developable photographic material. More specifically, this invention relates to dye fixing material for fixing an image capable of being formed in a heat-developable photographic material to a dye fixing layer without the necessity of supplying a solvent from outside.

BACKGROUND OF THE INVENTION

Photographic processes using silver halides have been most widely used because of their superior photographic characteristics such as sensitivity and the adjustment of gradation to other photographic processes such as an electrophotographic process and a diazo photographic process. In recent years, techniques capable of easily and rapidly obtaining images have been developed by changing the method of image formation and processing of silver halide photographic materials from the conventional wet treatment with developers or the like to a dry treatment by heating or the like.

Heat-developable light sensitive materials are known in the art. Heat-developable light sensitive materials and heat developing processes are described, for example, in *Fundamentals of Photographic Engineering,* pages 553–555, published by Corona Company, 1979; *Image Information,* page 40, published in April 1978; *Nebletts Handbook of Photography and Reprography,* 7th edition (Van Nostrand Reinhold Company), pages 32–33; U.S. Pat. Nos. 3,152,904, 3,301,678, 3,392,020, and 3,457,075; British Pat. Nos. 1,131,108 and 1,167,777; and *Research Disclosure,* June 1978, pages 9–15 (RD-17029).

Many methods have already been proposed for obtaining colored images by a dry process. With regard to the method of forming a colored image by the combination of an oxidation product of a developing agent with a coupler, U.S. Pat. No. 3,531,286 proposes a p-phenylenediamine reducing agent and a phenolic or active methylene coupler; U.S. Pat. No. 3,761,270, a p-aminophenolic reducing agent; Belgian Patent No. 802,519 and *Research Disclosure,* September 1975, pages 31–32, a sulfonamidephenol-type reducing agent; and U.S. Pat. No. 4,021,240, a combination of a sulfonamidephenol-type reducing agent and a 4-equivalents coupler.

These methods, however, have the defect that since an image of reduced silver and a color image occur simultaneously in the exposed portion after heat development, the color image becomes hazy. This defect may be eliminated by removing the silver image by a wet process, or transferring only the dye to a sheet having another layer such as an image receiving layer. It is not easy, however, to distinguish the dye from the unreacted material and transfer only the dye to the other layer.

*Research Disclosure,* May 1978, pages 54–58 (RD-16966) describes a method in which a silver salt is formed by introducing a nitrogen-containing heterocyclic group into the dye, and liberating the dye by heat development. According to this method, it is difficult to inhibit the liberation of the dye at portions not exposed to light. Hence, a clear image cannot be obtained, and the method is not applied generally.

With respect to a method of forming a positive color image by a thermosensitive silver dye bleaching process, useful dyes and a method of bleaching are described, for example, in *Research Disclosure,* April 1976, pages 30–32 (RD-14433), ibid. December 1976, pages 14–15 (RD-15227), and U.S. Pat. No. 4,235,957. In this process, an activator sheet must be superimposed during heating in order to quicken the bleaching of the dye, and an extra step and an extra material are required. It further has the defect that since the resulting color image is gradually reduced and bleached by free silver, etc., present together, it cannot withstand storage for an extended period of time.

A method of forming a color image by utilizing leuco dyes is described, for example, in U.S. Pat. Nos. 3,985,565 and 4,022,617. This method, however, has the defect that a leuco dye is difficult to include stably in a photographic material, and during storage, the photographic material is gradually colored.

Photographic materials capable of eliminating the defects of these conventional methods, and a method for image formation on such photographic materials are described in Japanese Patent Application (OPI) No. 149046/1983 (the term "OPI" as used herein mean a "published unexamined Japanese Patent Application"), and Japanese Patent Application No. 42092/1983 (corresponding to U.S. patent application Ser. No. 590,592 field on Mar. 16, 1984). In these methods, it is necessary to move a mobile dye formed imagewise to a dye fixing layer. For this purpose, a solvent for movement of the dye, such as water, a basic aqueous solution, an alcohol or dimethylacetamide is supplied, or a hydrophilic thermal solvent is included in the photographic material in advance so that the supply of solvent from outside is not particularly required. The latter method is advantageous because of its simplicity.

Furthermore, in the above image-forming methods, the combined use of a dye releasing activator such as a base is convenient in order to form a color image of high density rapidly.

However, many of these additives are chemically active, and when they are present together with silver halides, they may impair photographic characteristics or change storage stability. Furthermore, since the hydrophilic heat solvent is used in large quantities, its inclusion in the light sensitive material necessarily results in an increase film thickness. Consequently, the quality of the film is degraded or the sensitivity of the light sensitive material is reduced. Hence, the sharpness of the image is reduced.

Japanese Patent Application (OPI) No. 18351/1984 discloses a dye fixing material for eliminating such defects. This color fixing material does not have sufficient color fastness after storage in either dark or light room, and there is still room for improvement in peeling property between the image forming material and the dye fixing material after heat transfer.

SUMMARY OF THE INVENTION

The present invention is an improvement over the conventional dye fixing material described above.

A first object of this invention is to provide a dye fixing material which can be conveniently peeled from an image forming material after image transfer, and which prevents the resulting image from being damaged.

A second object of this invention is to provide a dye fixing material in which a final image obtained has sufficient color fastness after storage in either dark or light room.

A third object of this invention is to provide a process for easily forming an image having sufficiently good fastness after storage in either dark or light room.

These objects of this invention are achieved by a dye fixing material for fixing a mobile hydrophilic dye formed imagewise to a dye fixing layer, said imagewise dye being formed by heating a light sensitive material in a state containing substantially no water after or during imagewise exposure, said light sensitive material being composed of a support and provided thereon, at least (1) a light sensitive silver halide, (2) a binder and (3) a compound capable of forming the mobile dye imagewise by being chemically related to the reaction of reducing the silver halide to silver at high temperatures; wherein said dye fixing material comprises at least one layer containing as a constituent on a support a polymer having monomeric units of formula (I).

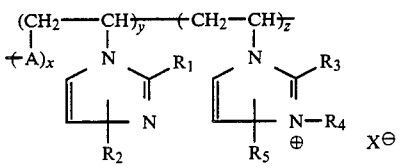

(I)

wherein A represents a vinyl monomer unit having no imidazole or imidazolium group, $R_1$ and $R_3$ represent a hydrogen atom, an alkyl group, an alkyl group substituted by a group capable of forming a coordinate bond with a metal, or a salt thereof, $R_2$ and $R_5$ represent a hydrogen atom or a alkyl, aralkyl or aryl group, $R_4$ represents an alkyl or aralkyl group, $X^{\ominus}$ represents an acid radical, x is from 0 to 80 mole%, y is from 10 to 100 mole%, z is from 0 to 50 mole%, and y is not less than z.

DETAILED DESCRIPTION OF THE INVENTION

When the light sensitive material used in this invention is heated in a state containing substantially no water after or simultaneously with imagewise exposure, a mobile hydrophilic dye image is obtained simultaneously with the formation of a silver image either in the exposed portion or the unexposed portion with the exposed light sensitive silver halide as a catalyst. In this invention, this developing step is referred to as "heat development". In the heat-developed state, the formed or released mobile hydrophilic dye image is difficult to distinguish because the unreacted dye-releasing redox compound, silver halide, developed silver, etc. are present together. Furthermore, the storage stability of the developed photographic material is extremely poor. In this invention, however, the dye of the resulting dye image is a hydrophilic mobile dye, and therefore the hydrophilic dye can be moved to a dye fixing layer in an atmosphere for which the hydrophilic dye has affinity. Consequently, a dye image can be obtained having excellent quality and storage stability. This step is a step of "dye fixation" in this invention.

The dye fixing step can be carried out mainly by supplying a solvent: see Japanese Patent Application (OPI) Nos. 58543/1983, 79247/1983 and 149046/1983. Furthermore, by making an atmosphere having affinity for the hydrophilic dye under the presence of a hydrophilic thermal solvent, a dye image having good color reproduction can be formed without particularly using a solvent, and therefore by a completely dry processing which does not at all use solvent in the all process from exposure, heat development to dye fixation, the good dye image can be formed (Japanese Patent Application (OPI) No. 181351/1984).

The theory of this process is essentially the same for a light sensitive material having a negative emulsion and a light sensitive material having an autopositive emulsion and only differs in that the portion to be developed is an exposed portion in one case and an unexposed portion in the other case. Accordingly, even when an autopositive emulsion is used, a dye image having good color reproducibility can be obtained in the same way as in the case of using a negative emulsion.

Heating in a state containing substantially no water, as used herein, means heating at a temperature of from 80° to 250° C. The "state containing substantially no water" means that the reaction system is in equilibrium with water in the air, and water for inducing or promoting the reaction is not particularly supplied. Such a condition is described at page 374 of *The Theory of the Photographic Process*, 4th edition, T. H. James, published by Macmillan Co., 1976.

The expression "capable of forming the mobile dye imagewise by being chemically related to the reaction of reducing the silver halide to silver at high temperatures" means the following four reactions. For example, with a negative silver halide emulsion, a development nucleus is formed in the silver halide upon exposure, and an oxidation-reduction occurs between th silver halide with a reducing agent or a dye releasing redox compound. Consequently, one of the following reactions takes place. (1) A reaction in which the reducing agent is oxidized and the oxidation product reacts with a compound capable of forming or releasing a mobile dye to form or release the mobile dye. (2) A reaction in which a dye releasing redox compound which dose not inherently release a mobile dye by heating undergoes an oxidation-reduction reaction with the remaining reducing agent to release the mobile dye. (3) A reaction in which a dye releasing redox compound which inherently releases a mobile dye by heating is oxidized and thus no longer releases the mobile dye. (4) A reaction in which the dye releasing redox compound is oxidized, and the oxidized dye releasing redox compound releases a mobile dye. When a positive silver halide emulsion is used instead of the negative silver halide emulsion, the above reactions take place in non-exposed portions. In the case of the reactions (1) and (4), a dye image which is positive with regard to the silver image is obtained, and in the case of the reactions (2) and (3), a dye image which is negative with regard to the silver image is obtained.

Some examples of th compound capable of forming a mobile dye imagewise, which can be used in this invention, are given below.

(1) Dye releasing compounds capable of releasing mobile dyes by reaction with the oxidation product of a reducing agent formed by an oxidation-reduction reaction with a silver halide which takes place by heating i.e., compounds releasing mobile dyes according to the reaction (1) above.

The compounds described in Japanese Patent Application (OPI) No. 79247/1983 correspond to these compounds. These compounds are represented by formula C-L-D wherein D represents an image forming dye moiety to be described hereinbelow, L represents such a linking group that during the reaction of the oxidation product of a reducing agent with C, the C-L linkage is cleaved, and C represents a substrate to be combined with the oxidation product of the reducing agent, such as active methylene, active methine, a phenol residue, or a naphthol residue.

Preferably, these residues are represented by one of formulae (A) to (G).

(A)

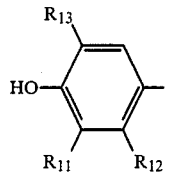

(B)

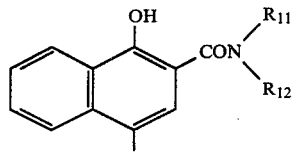

(C)

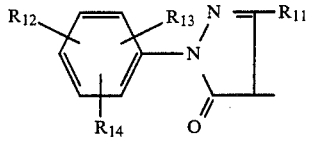

(D)

$R_{11}COCHCOR_{12}$ (E)

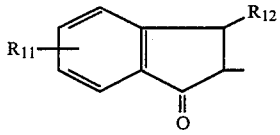

(F)

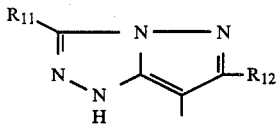

(G)

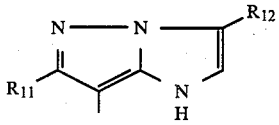

In these formulae, each of $R_{11}$, $R_{12}$, $R_{13}$ and $R_{14}$ represents a substituent group selected from a hydrogen atom, alkyl groups, cycloalkyl groups, aryl groups, alkoxy groups, aryloxy groups, aralkyl groups, acyl groups, acylamino groups, alkoxyalkyl groups, aryloxyalkyl groups, N-substituted carbamoyl groups, alkylamino groups, arylamino groups, halogen atoms, acyloxy groups, acyloxyalkyl groups and a cyano group. These substituent groups may further be substituted by a hydroxyl group, a cyano group, a nitro group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group, or an acyl group.

The substrate C should have the action of releasing a mobile dye by combination with the oxidation product of a reducing agent and also contain a ballast group which prevents the dye releasing redox compound from being diffused to a dye receptive image receiving layer. Preferred ballast groups are hydrophobic groups such as alkyl groups, alkoxyalkyl groups and aryloxyalkyl groups. Desirably, the total number of carbon atoms of the ballast group is at least 6, and the total number of carbon atoms of the substrate C is at least 12.

(2) Couplers capable of forming mobile dyes by a coupling reaction with the oxidation product of a reducing agent formed by the oxidation-reduction reaction with a silver halide which takes place by heating, i.e., compounds forming mobile dyes by the reaction (1) above.

Examples of such couplers are the couplers described in Japanese Patent Application (OPI) No. 149046/1983 and Japanese Patent Application No. 32547/1982 which have releasing groups containing diffusion-resistant groups in order to give the couplers diffusion resistance. The diffusion resistance denotes a condition in which the movement of molecules in a hydrophilic binder is inhibited mainly by the size and form of the molecules. Diffusion resistance can be achieved by incorporating diffusion-resistant ballast groups into the releasing groups of the couplers. On the other hand, dyes formed by the reaction of the couplers with the oxidation products of reducing agents have good mobility because they have no ballast group.

Such diffusion-resistant couplers are substrates which form dyes by combination with the oxidation products of reducing agents formed by the reaction of reducing agents typified by p-aminophenol derivatives or p-phenylenediamine derivatives with silver halides, and are represented by formulae (M) to (U).

(M)

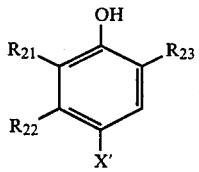

(N)

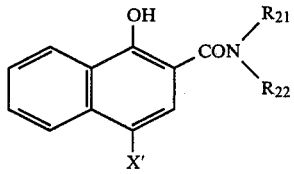

(O)

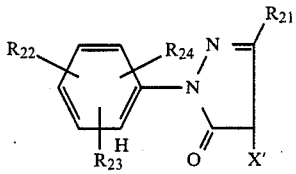

(P)

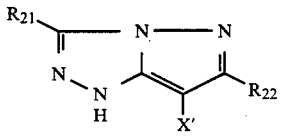

-continued (Q)

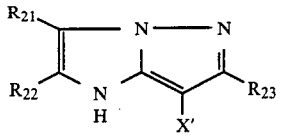

(R)

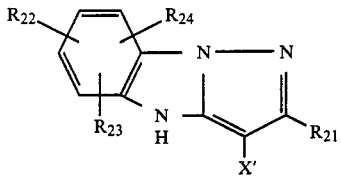

(S)

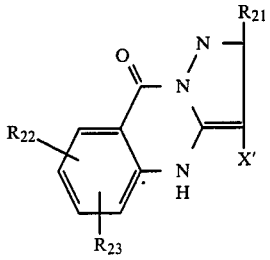

(T)

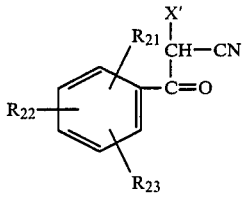

(U)

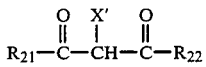

In the above formulae, each of $R_{21}$, $R_{22}$, $R_{23}$ and $R_{24}$ represents a substituent selected from a hydrogen atom, alkyl groups, alkenyl groups, cycloalkyl groups, aryl groups, aralkyl groups, alkoxy groups, aryloxy groups, acyl groups, acyloxy groups, acylamino groups, alkoxyalkyl groups, aryloxyalkyl groups, alkoxycarbonyloxy groups, alkoxycarbonylamino groups, alkoxycarbonyl groups, carbamoyl groups, substituted carbamoyl groups, sulfamoyl groups, substituted sulfamoyl groups, amino groups, alkylamino groups, dialkylamino groups, arylamino groups, cycloalkylamino groups, halogen atoms, cyano groups, acyloxyalkyl groups, a nitro groups alkylsulfonyl groups, arylsulfonyl groups, a hydroxyl group, a carboxyl group, a sulfo group, a ureido group, substituted ureido groups, sulfamoylamino groups, substituted sulfamoylamino groups, alkylsulfonyloxy groups, arylsulfonyloxy groups, alkylsulfonylamino groups, arylsulfonylamino groups, alkylthio groups, arylthio groups, heterocyclic groups, an imide group, and a quaternary ammonium group. These substituents may further be substituted by a hydroxyl group, a carboxyl group, a sulfo group, an alkoxy group, a cyano group, a nitro group, an alkyl group, an aryl group, an aryloxy group, an acyloxy group, an acyl group, a sulfamoyl group, a substituted sulfamoyl group, a carbamoyl group, a substituted carbamoyl group, a acylamino group, an alkylsulfonylamino group, an arylsulfonylamino group, a sulfamoylamino group, a substituted sulfamoylamino group, an imide group, a halogen atom or a quaternary ammonium group. The total number of carbons of the substituents $R_{21}$, $R_{22}$, $R_{23}$ and $R_{24}$ is less than 12, and each of these substituents has not more than 8 carbon atoms.

X' is a group which is released when the coupler is combined with the oxidation product of the reducing agent, and is a substituent selected from alkoxy groups, aryloxy groups, acyloxy groups, alkoxycarbonyloxy groups, a carbamoyloxy group, substituted carbamoyloxy groups, alkylsulfonyloxy groups, arylsulfonyloxy groups, alkylsulfonylamino groups, arylsulfonylamino group, perfluoroacylamino groups, a sulfamoylamino group, subsitituted sulfamoylamino groups, alkylsulfonyl groups, arylsulfonyl groups, alkylthio groups, arylthio groups, heterocyclic thio groups, arylazo groups, heterocyclic groups and an imido groups. These substitutents may further be substituted by an alkyl group, an alkenyl group, a cycloalkyl group, an aralkyl group, an aryl group, a halogen atom, an alkoxy group, an aryloxy group, an acyl group, an acylamino group, an acyloxy group, an alkylsulfonylamino group, an arylsulfonylamino group, an alkylsulfonyloxy group, an arylsulfonyloxy group, an alkoxycarbonyl group, a substituted ureido group, an alkoxycarbonyl group, or an alkoxycarbonylamino group. X' has at least 8 carbon atoms in total.

As described above, the above couplers form mobile dyes by combination with the oxidation products of the reducing agents, but the couplers themselves are desirably not mobile. For this purpose, in the above general formulae (M) to (U), the substituent groups $R_{21}$ to $R_{24}$ are preferably those which do not inhibit diffusion in hydrophilic binders. Specifically, the couplers are desirably relatively hydrophilic and low molecular weight, and the substituent X' is desirably one which inhibits diffusion of the coupler itself, namely one which is hydrophobic and has a high molecular weight and acts as a ballast group.

(3) Compounds having diffusion resistance which do not intrinsically release mobile dyes, but when reduced, release mobile dyes, in accordance with the reaction (2). The compounds which induce an intramolecular nucleophilic reaction as described in U.S. Pat. No. 4,139,379 correspond to these compounds.

Diffusion-resistant dye releasing redox compound which intrinsically does not release hydrophilic dyes but do so when reduced (to be referred to as reducible dye releasing agents) are, for example, ballast-stabilized compounds which release mobile dyes upon undergoing intramolecular nucleophilic substitution.

The reducible dye releasing agents become useful when combined with electron donors (reducing agents which give electrons required for enabling the reducible dye releasing agents to be reduced to a form which undergoes intramolecular nucleophilic substitution). When by exposure the electron donor is given in an imagewise dispersed state to photographic elements, the electron donor gives electrons to the ballast-stabilized electron-acceptive nucleophilic substituted compound according to an image pattern. Consequently, imagewise substitution occurs subsequently and a dye is released.

The reducible dye releasing agents which have been found especially useful in heat development color photograph, i.e. processing and heat-development color photographic elements can be represented by the following model formula.

(Ballast-stabilized carrier) $x_0$—(electrophilic releasing group) $y_0$—(mobile dye component) $z_0$ In the above formulae, $x_0$, $y_0$ and $z_0$ are positive integers, preferably 1 or 2. They include compounds having at least one mobile component bonded to one ballast group, or compounds having at least one ballast bonded to one mobile component. The ballast-stabilized carrier is a group capable of rendering the aforesaid compounds immobile under heat diffusion transfer conditions. The ballast-stabilized carrier contains a group which, when it accepts at least one electron, provides a nucleophilic group (i.e., a group capable of inducing intramolecular nucleophilic substitution with the aforesaid electrophilic cleavage group).

The above reducible dye releasing agents contain, a electrophilic releasing group in each linking group linking the ballast-stabilized carrier to each mobile component, and a nucleophilic group formed by reduction reacts with the electrophilic releasing group. As a result, some groups remain together with the ballast-stabilized carrier, and some groups remain together with the mobile component.

The reducible dye releasing agent contains a nucleophilic precursor group and an electrophilic cleavage group bonded through a linking group.

A preferred example of the reducible dye releasing agent is one which has from 1 to about 5 atoms, and preferably 3 or 4 atoms, between an atom which becomes the center of reaction in a nucleophilic reaction and an atom which becomes the center of reaction in a electrophilic reaction. It can be represented by formula (II).

(II)

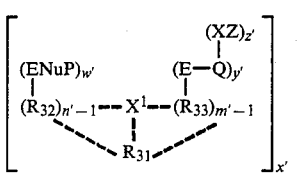

In the formula (II), w', x', y', z', n' and m are each positive integer 1 or 2; ENuP represents an electron-acceptive nucleophilic group precursor, such as a precursor of a hydroxylamino group (including a nitroso group (NO), a stable nitroxyl free radical (N—O.), and preferably a nitro group ($NO_2$)), or a precursor of a hydroxyl group (preferably an oxo group (=O)), or an imine group (which is hydrolyzed to an oxo group before it accepts an electron in an alkaline environment); $R_{31}$ is an organic group containing not more than 50 atoms, preferably not more than 15 atoms; $R_{32}$ and $R_{33}$ represents a divalent organic group composed of a divalent linking group containing from 1 to 3 atoms, which may be an alkylene group, or oxaalkylene, thiaalkylene, azaalkylene, or alkyl- or aryl-substituted nitrogen. These are groups containing at least 8 carbon atoms which contain a large group on the side chain of the linking group and can have function as a ballast. When $X^1$ itself is a ballast group, these groups are $X^1$; E and Q provide electrophilic cleavage groups, and E is a center of an electrophilic reaction; Q is a group which provides a single atom bond between E and $X^2$ wherein the single atom is a nonmetallic atom of Group Va or VIa of the periodic table which is in an atomic valency state of −2 or −3, such as an oxygen, sulfur or selenium atom. These atoms provide two covalent bonds linking $X^2$ to E, and as a result, where they form a 5- to 7-membered ring together with $X^2$ and these atoms are trivalent atoms, Q may be monosubstituted by a hydrogen atom, an alkyl group having from 1 to 20 carbon atoms, preferably from 1 to 10 carbon atoms (including substituted carbon atoms and carbocyclic groups) or an aryl group having from 6 to 20 carbon atoms (including substituted aryl groups); $X^1$ is a substituent group on at least one of $R_{31}$, $R_{32}$ and $R_{33}$, one of $X^1$ and Q-$X^2$ represents a ballast group having a size large enough to render the aforesaid compound immobile in a layer of a photographic element and the other is a photographically useful dye or its precursor, and $X^1$ and Q-$X^2$ also include linking groups linking them respectively to $R^1$ and E, respectively; and $R_{31}$, $R_{32}$ and $R_{33}$ are selected so as to provide substantial proximity to E of ENuP and thus permit intramolecular nucleophilic releasing of Q from E. They are selected so as to provide 1 or 3 to 5 atoms between an atom forming a center of reaction in a nucleophilic reaction and an atom forming a center of reaction in an electrophilic reaction, whereby the aforesaid compound can form a 3-, 5- or 7-membered ring during the intramolecular nucleophilic substitution of the group Q-$X^2$ from the aforesaid electrophilic group.

(4) Compounds which intrinsically release mobile dyes when heated, but by the oxidation-reduction reaction with silver halide which occurs by heating, fail to release mobile dyes, (in accordance with the aforesaid reaction (3)).

Examples of such dye releasing redox compounds are the reduction products of the nucleophilic groups of compounds described in U.S. Pat. No. 4,139,379. They are represented by formulae IA or IB.

(IA)

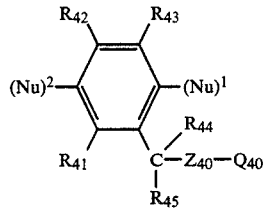

(IB)

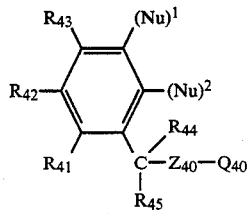

In the above formulae, $(Nu)^1$ and $(Nu)^2$ each represent a nucleophilic group, such as the —OH group or $NH_2$— group; $Z_{40}$ represents a divalent atomic group, such as a sulfonyl group which is electronegative with respect to the carbon atoms at which $R_{44}$ and $R_{45}$ are substituted; $Q_{40}$ represents a dye moiety; each of $R_{41}$, $R_{42}$ and $R_{43}$ represents a hydrogen atom, a halogen atom, an alkyl group, an alkoxy group, or an acylamino group; when $R_{41}$ and $R_{42}$ are present at adjacent positions on the ring, the remainder of the molecules forms a condensed ring; with regard to $R_{42}$ and $R_{43}$, the remainder of the molecules forms a condensed ring; $R_{44}$ and $R_{45}$ may be identical or different, and each represents a hydrogen atom, a hydrocarbon group, or a substituted hydrocarbon group; and at least one of $R_{41}$, $R_{42}$, $R_{43}$, $R_{44}$ and $R_{45}$ includes a group having a size sufficiently large to render the aforesaid compound immobile in a layer of a photographic element, i.e. a diffusion-resistant group.

A residue which imparts diffusion resistance is a residue which can inhibit movement of a compound containing this residue in a hydrophilic colloid normally used in photographic materials. Organic residues which generally carry a straight-chain or branched-chain aliphatic group, or those wihch can carry a carbocyclic, heterocyclic or aromatic group having from 8 to 20 carbon atoms are preferably used for this purpose. These residues are bonded to the remainder of the molecules either directly or indirectly through, for example, —NHCO—, —$NHSO_2$—, —NR— (wherein R is hydrogen or alkyl), —O—, —S— or —$SO_2$—. The diffusion-resistant residues may further carry a group which imparts solubility in water, such as a sulfo group or a carboxyl group (which may be present in the form of an anion). Since mobility is determined by the size of the molecules as a whole of a compound, when, for example, the molecules as a whole are sufficiently large, the "diffusion-resistant group" can have a group of a shorter chain length.

Another example of the dye releasing redox compound includes compounds represented by formula (III).

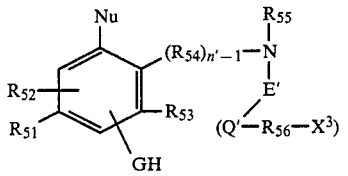

(III)

In formula (III), Nu represents a nucleophilic group, such as —$NH_2$ group or —OH group; GH represents an oxidizing group such as an amino group, including alkylamino group, or a sulfonamide group, or GH is a cyclic group formed together with $R_{51}$ or $R_{53}$ or any group specified with regard to Nu; E is an electrophilic group which may be carbonyl —CO— or thiocarbonyl —CS—; Q' is a group which provides a single atom bonded between E and $R_{56}$ wherein the single atom is a nonmetallic atom of Group Va or VIa of the periodic table in an atomic valency state of −2 or −3, such as nitrogen, oxygen, sulfur or selenium atom, and the aforesaid atom provides two covalent bonds bonding E' to $R_{56}$, and when Q' is a trivalent atom, it represents a hydrogen atom, an alkyl group having 1 to 10 carbon atoms, including-substituted alkyl groups, an aromatic group having 5 to 20 carbon atoms (including aryl groups and substituted aryl groups) or atomic groups required to form a 5- to 7-membered ring together with $R_{56}$ (such as a pyridine or piperidine group); $R_{54}$ represents an alkylene group, including an alkylene group having a substituent group, having from 1 to 3 carbon atoms in a linking group, or at least one methylene in the linking group is a dialkyl or diarylmethylene linking group; n' is an integer of 1 or 2; $R_{56}$ can be an aromatic group containing at least 5 atoms, and preferably from 5 to 20 atoms, which includes heterocyclic groups, for example groups containing rings such as pyridine, tetrazole, benzimidazole, benzotriazole or isoquinoline, or carboxylic arylene groups containing from 6 to 20 carbon atoms (preferably including phenylene and nephthylene groups substituted by a phenylene or naphthylene group), or $R_{56}$ may be an aliphatic hydrocarbon group such as an alkylene group having from 1 to 12 carbon atoms which includes substituted alkylene groups; $R_{55}$ may be an alkyl group having 1 to 40 carbon atoms, including substituted alkyl groups and cycloalkyl groups, or an aryl group having from 6 to 40 carbon atoms, including substituted aryl groups, and may have the function of a ballast group; each of $R_{53}$, $R_{51}$ and $R_{52}$ represents a one-atom substituent such as a hydrogen or halogen atom, but preferably a multiatom-substituent group such as an alkyl group having from 1 to 40 carbon atoms (including substituted alkyl groups and cycloalkyl groups), an alkoxy group, an aryl group having from 6 to 40 carbon atoms (including substituted aryl groups), a carbonyl group, a sulfamyl group or a sulfonamide group, provided that when $R_{56}$ is an aliphatic hydrocarbon group such as an alkylene group, $R_{52}$ and $R_{51}$ should be multiatom substituent groups; and $R_{54}$ is selected so as to provide substantial proximity to the nucleophilic group E' and thus to permit intramolecular nucleophilic reaction accompanied by releasing of Q' from E', whereby the aforesaid compound can form a 5- to 8-membered ring, most preferably a 5- or 6-membered ring by the intramolecular nucleophilic substitution of the group —$(Q\text{-}R_{56}—X^3)$ from the electrophilic group.

(5) Reducible dye releasing redox compounds which release mobile dyes after they have been oxidized to oxidation products, according to aforesaid reaction (4).

The reducible dye releasing redox compound which releases a hydrophilic diffusible dye used in this invention is represented by formula (IV):

$$Ra\text{-}SO_2\text{-}Da \qquad (IV)$$

wherein Ra represents a reducing group capable of being oxidized by the silver halide; and Da represents an image forming dye portion containing a hydrophilic group.

Preferably the reducing group Ra in the dye releasing redox compound Ra-$SO_2$-Da has an oxidation-reduction potential compared to a saturated calomel electrode of 1.2 V or less measuring the polarographic half wave potential using acetonitrile as a solvent and sodium perchlorate as a base electrolyte. Preferred examples of the reducing group Ra include those represented by formulae (IV-1) to (IV-8).

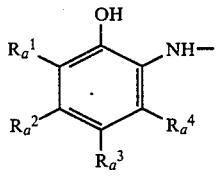

(IV-1)

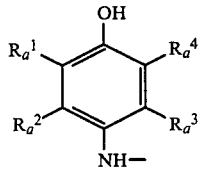

(IV-2)

-continued (IV-3)

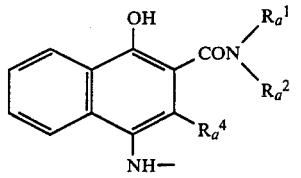

(IV-4)

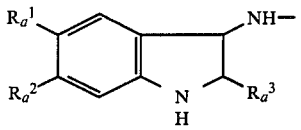

(IV-5)

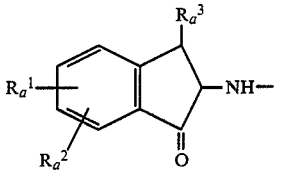

(IV-6)

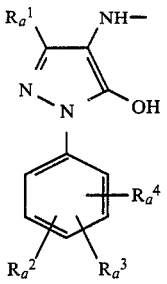

(IV-7)

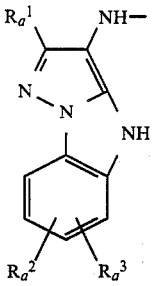

(IV-8)

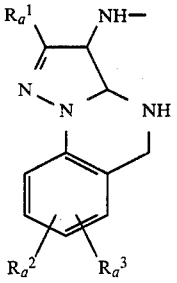

wherein $R_a^1$, $R_a^2$, $R_a^3$ and $R_a^4$ each represents a hydrogen atom or a substituent group selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl grop, an N-substituted carbamoyl group, an N-substituted sulfamoyl group, a halogen atom, an alkylthio group or an arylthio group. The alkyl moiety and the aryl moiety in the above described substituent groups may be further substituted with an alkoxy group, a halogen atom, a hydroxy group, a cyano group, an acyl group, an acylamoni group, a substituted carbamoyl group, a substituted sulfamoyl group, an alkylsulfonylamino group, an arylsulfonylamino group, a substituted ureido group or a carboalkoxy group. Furthermore, the hydroxy group and the amino group included in the reducing group represented by Ra may be protected by a protective group capable of reproducing the hydroxy group and the amino group by the action of a nucleophilic agent.

In more preferred embodiments of the present invention, the reducing group Ra is represented by formula (IV-9)

(IV-9)

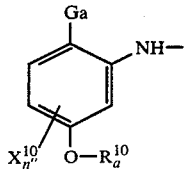

wherein Ga represents a hydroxy group or a group giving a hydroxy group upon hydrolysis; $R_a^{10}$ represents an alkyl group or an aromatic group; n'' represents an integer of 1 to 3; $X^{10}$ represents an electron donating substituent group when n'' is 1 or substituent group, which may be the same or different, one of the substituents being an electron denating group and the second or second and third substituent groups being selected from an electron donating group or a halogen atom when n'' is 2 or 3, respectively; wherein $X^{10}$ groups may form a condensed ring with each other or with $OR_a^{10}$; and the total number of the carbon atoms included in $R_a^{10}$ and $X^{10}$ is not less than 8.

Of the reducing groups represented by the formula (VI-9), more preferred reducing groups Ra are represented by the following general formulae (IV-9-a) and (IV-9-b):

(IV-9-a)

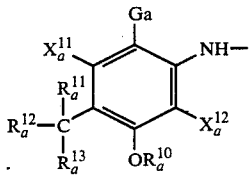

wherein Ga represents a hydroxy group or a group giving a hydroxy group upon hydrolysis; $R_a^{11}$ and $R_a^{12}$, which may be the same or different, each represents an alkyl gorup or $R_a^{11}$ and $R_a^{12}$ may be bonded to each other to form a ring; $R_a^{13}$ represents a hydrogen atom or an alkyl group; $R_a^{10}$ represents an alkyl group or an aromatic group; $X_a^{11}$ and $X_a^{12}$, which may be the same or different, each represents a hydrogen atom, an alkyl group, an alkoxy group, a halogen atom, an acylamino group or an alkylthio group; land $R_a^{10}$ and $X_a^{12}$ or $R_a^{10}$ and $R_a^{13}$ may be bonded to each other to form a ring, (IV-9-b)

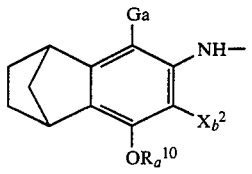

wherein Ga represents a hydroxy group or a group giving a hydroxy group upon hydrolysis; $R_a^{10}$ represents an alkyl group or an aromatic group; $X_b^2$ represents a hydrogen atom, an alkyl group, an alkoxy group, a halogen atom, an acylamino group or an alkylthio group; and $X_b^2$ and $R_a^{10}$ may be bonded to each other to form a ring.

Specific examples of the reducing groups represented by the above described general formulae (IV-9), (IV-9-a) and (IV-9-b) are described in U.S. Pat. No. 4,055,428, Japanese Patent Application (OPI) Nos. 12642/81 and 16130/81, respectively.

In other more preferred embodiments of this invention, the reducing group Ra is represented by formula (IV-10).

(IV-10)

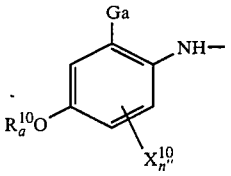

wherein Ga, $X^{10}$, $R_a^{10}$ and n'' each has the same meaning as Ga, $X^{10}$, $R_a^{10}$ and n'' defined in the general formula (IV-9).

Of the reducing groups represented by formula (IV-10), more preferred reducing groups Ra are represented by formulae (IV-10-a), (IV-10-b) and (IV-10-c)

(IV-10-a)

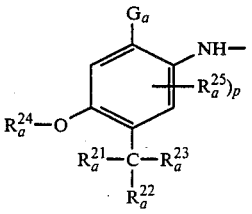

wherein Ga represents a hydroxy group or a group giving a hydroxy group upon hydrolysis; $R_a^{21}$ and $R_a^{22}$, which may be the same or different, each represents an alkyl group or an aromatic group, and $R_a^{21}$ and $R_a^{22}$ may be bonded to each other to form a ring; $R_a^{23}$ represents a hydrogen atom, an alkyl group or an aromatic group; $R_a^{24}$ represents an alkyl group or an aromatic group; $R_a^{25}$ represents an alkyl group, an alkoxy group, an alkylthio group, an arylthio group, a halogen atom or an acylamino group; p is 0, 1 or 2; $R_a^{24}$ and $R_a^{25}$ may be bonded to each other to form a condensed ring; $R_a^{21}$ and $R_a^{24}$ may be bonded to each other to form a condensed ring; $R_a^{21}$ and $R_a^{25}$ may be bonded to each other to form a condensed ring; and the total number of the carbon atoms included in $R_a^{21}$, $R_a^{22}$, $R_a^{23}$, $R_a^{24}$ and $(R_a^{25})_p$ is more than 7.

(IV-10-b)

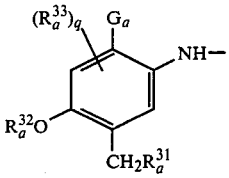

wherein Ga represents a hydroxy group or a group giving a hydroxy group upon hydrolysis; $R_a^{31}$ represents an alkyl group or an aromatic group; $R_a^{32}$ represents an alkyl group or an aromatic group; $R_a^{33}$ represents an alkyl group, an alkoxy group, an alkylthio group, an arylthio group, a halogen atom or an acylamino group; q is 0, 1 or 2; $R_a^{32}$ and $R_a^{33}$ may be bonded to each other to form a condensed ring; $R_a^{31}$ and $R_a^{32}$ may be bonded to each other to form a condensed ring; $R_a^{31}$ and $R_a^{33}$ may be bonded to each other to form a condensed ring; and the total number of the carbon atoms included in $R_a^{31}$, $R_a^{32}$ and $(R_a^{33})q$ is more than 7.

(IV-10-c)

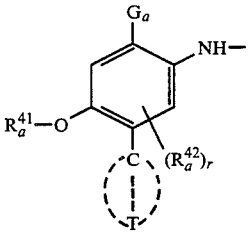

wherein Ga represents a hydroxy group or a group giving a hydroxy group upon hydrolysis; $R_a^{41}$ represents an alkyl group or an aromatic group; $R_a^{42}$ represents an alkyl group, an alkoxy group, an alkylthio group, an arylthio group, a halogen atom or an acylamino group; r is 0, 1 or 2; the group of

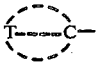

represents a group in which 2 to 4 saturated hydrocarbon rings are condensed, the carbon atom

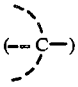

in the condensed ring which is connected to the phenol nucleus (or a precursor thereof), represents a tertiary carbon atom which composes of one element of the condensed ring, a part of the carbon atoms (excluding the above described tertiary carbon atom) in the hydrocarbon ring may be substituted for oxygen atom(s), the hydrocarbons ring may have a substituent group, and an aromatic ring may be further condensed to the hydrocarbon ring; $R_a^{41}$ or $R_a^{42}$ and the group of

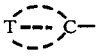

may be bonded to each other to form a condensed ring; and the total number of the carbon atoms included in $R_a^{41}$, $(R_a^{42})_r$ and the group of

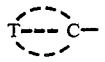

is not less than 7.

Specific examples of the reducing groups represented by the above formulae (IV-10), (IV-10-a), (IV-10-b) and (IV-10-c) are described in Japanese Patent Application (OPI) Nos. 16131/81, 650/82 and 4043/82.

The essential part in the groups represented by the general formulae (IV-2) and (IV-3) is a para(sulfonyl-)aminophenol part. Specific examples of these reducing groups are described in U.S. Pat. Nos. 3,928,312 and 4,076,529, U.S. Published Patent Application B Ser. No. 351,673, U.S. Pat. Nos. 4,135,929 and 4,258,120. These groups are also effective for the reducing group Ra according to the present invention.

In still other more preferred embodiments of this invention, the reducing group Ra is represented by formula (IV-11).

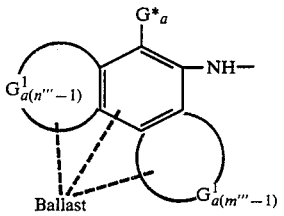

(IV-11)

wherein Ballast represents a diffusion-resistant group; $G_a^*$ represents a hydroxy group or a precursor of a hydroxy group; $G_a^1$ represents an aromatic ring directly condensed to the benzene nucleus to form a naphthalene nucleus; and n''' and m''' are nonequal positive integers of 1 or 2.

Specific examples of the reducing groups represented by the above described formula (IV-11) are described in U.S. Pat. No. 4,053,312.

The reducing groups represented by the above described formulae (IV-4), (IV-6), (IV-7), and (IV-8) are characterized by containing a heterocyclic ring. Specific examples of the groups are described in U.S. Pat. No. 4,198,235, Japanese Patent Application (OPI) No. 46730/78 and U.S. Pat. No. 4,273,855.

Specific examples of the reducing groups represented by formula (IV-5) are described in U.S. Pat. No. 4,149,892.

Characteristics required for the reducing group Ra are as follows.

1. It is rapidly oxidized by the silver halide to effectively release a diffusible dye for image formation by the function of the dye releasing activator.

2. The reducing group Ra has an extensive hydrophobic property, because it is necessary for the dye releasing redox compound to be diffusion-resistant in a hydrophilic or hydrophobic binder and that only the released dye has diffusibility.

3. It has excellent stability to heat and to the dye releasing activator and does not release the image forming dye until it is oxidized; and 4. It is easily synthesized.

The specific examples of preferred reducing groups Ra which satisfy the above described requirements are described in European Pat. No. 76492.

Examples of dyes which can be used for image forming dye include azo dyes, azomethine dyes, anthraquinone dyes, naphthoquinone dyes, styryl dyes, nitro dyes, quinoline dyes, carbonyl dyes and phthalocyanine dyes, etc. Representative examples of them are set forth below and are classified by hue. Further, these dyes can be used in a form temporarily shifted to shorter wavelength region which is capable of regeneration during the development processing.

Yellow

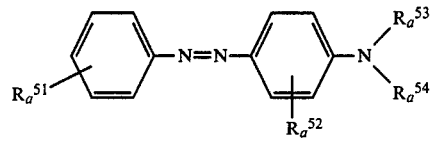

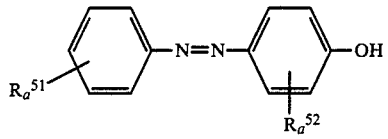

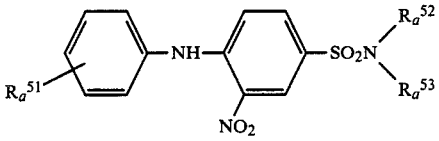

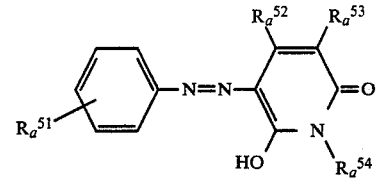

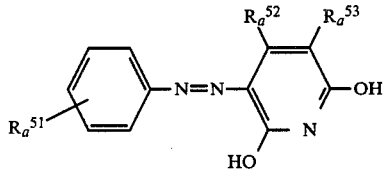

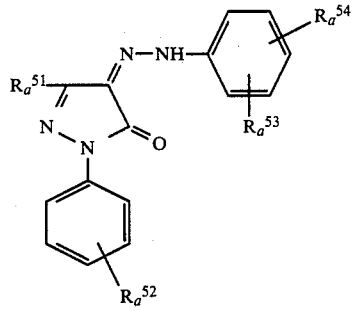

-continued
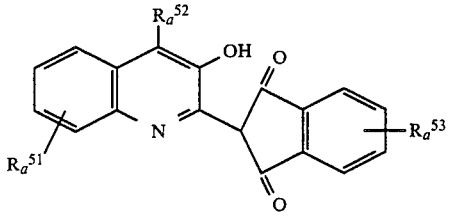
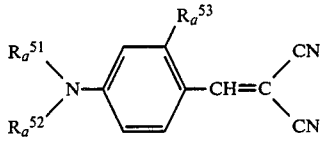
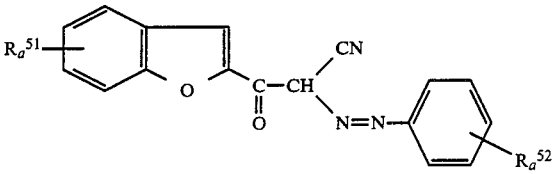
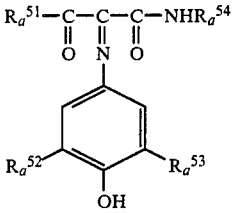
Magenta
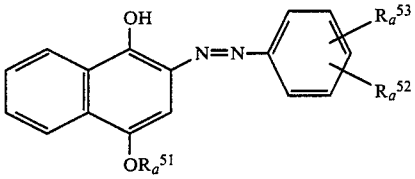
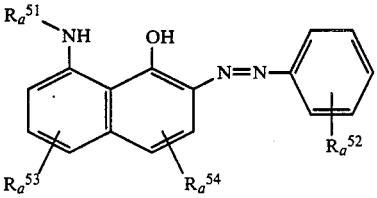
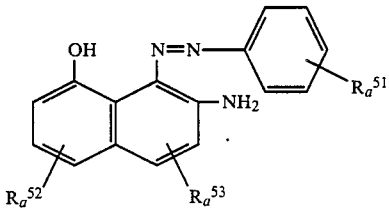
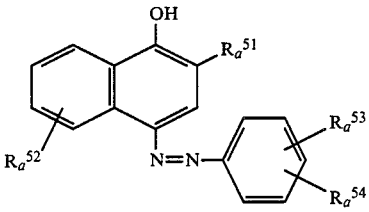
-continued
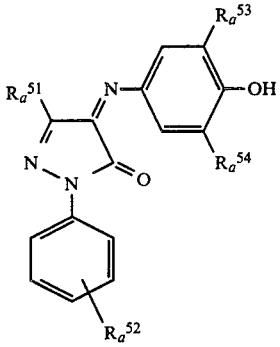
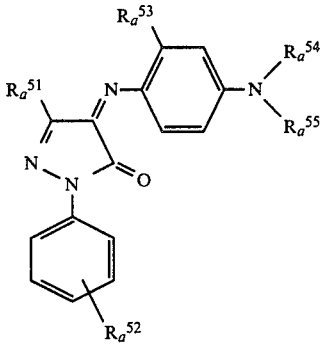
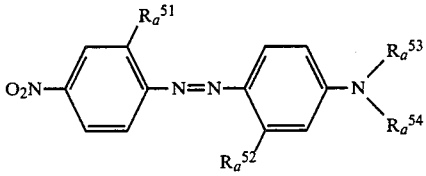
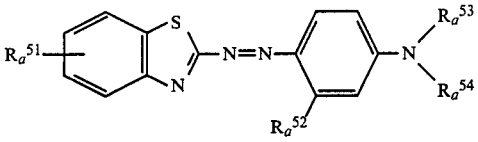
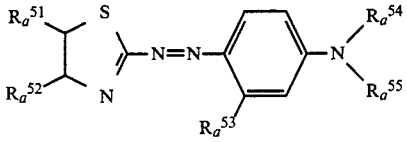
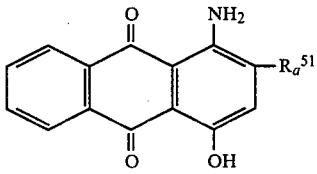
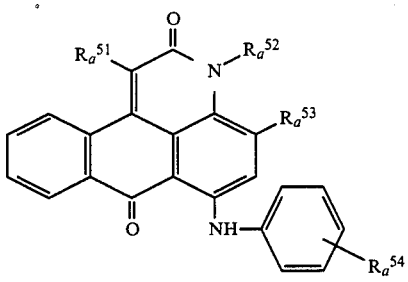

-continued
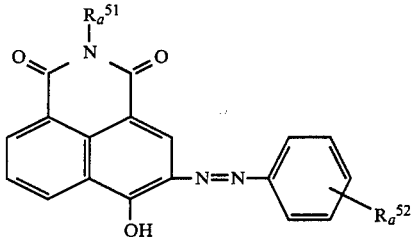
Cyan
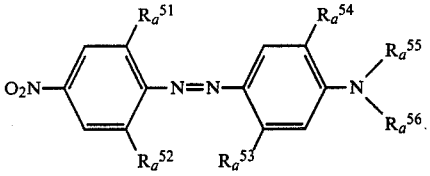
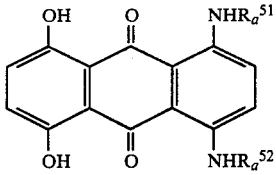
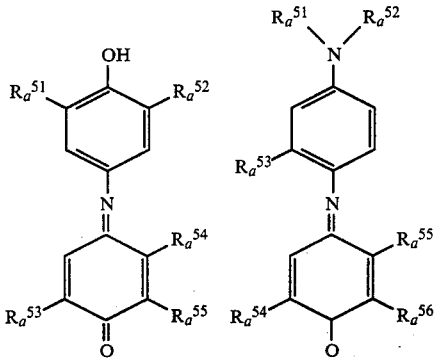
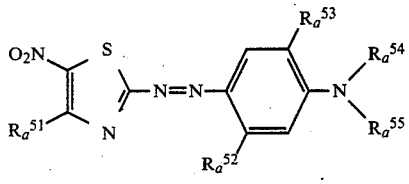
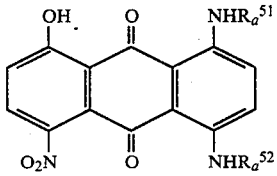
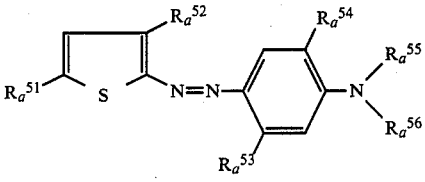
-continued
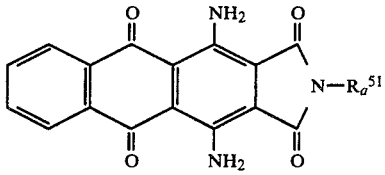
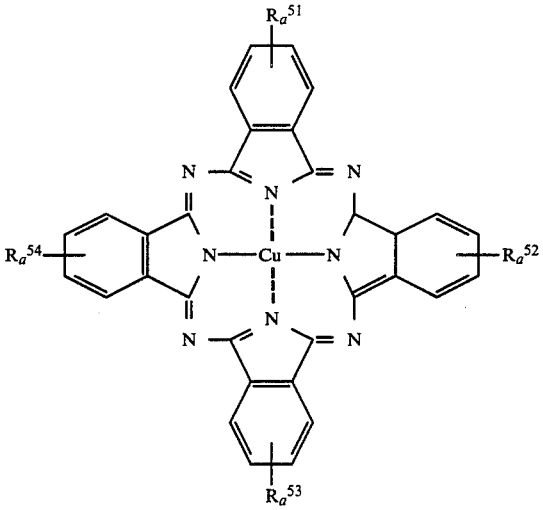
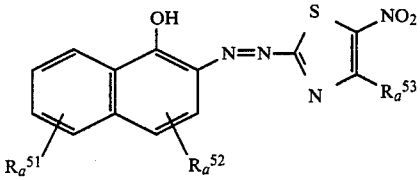
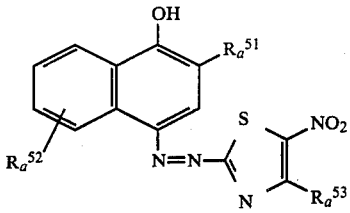
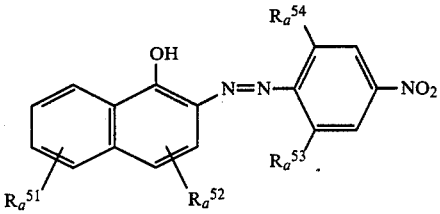
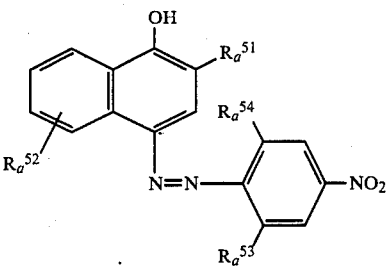
In the above described formulae, $R_a^{51}$ to $R_a^{56}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group, or an arylthio group. The alkyl moiety and the aryl moiety in the above described substituent groups may be further substituted with a halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, a alkylsulfonylamino group, an arylsulfonylamino group, or a ureido group.

Examples of the hydrophilic groups include a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, a alkoxy group, a hydroxyalkoxy group, an alkoxyalkoxy group, etc.

In the present invention, those in which the hydrophilic property thereof is increased by dissociation of a proton under a basic condition are particularly preferred. Examples of these groups include a phenolic hydroxy group, a carboxy group, a sulfo group, a phosphoric acid group, an imido group, a hydroxamic acid group, a substituted or unsubstituted sulfamoyl group, a substituted or unsubstituted sulfamoylamino group, etc.

Characteristics required for the image forming dye are as follows.

1. It has a hue suitable for color reproduction.
2. It has a large molecular extinction coefficient.
3. It is fast to light and heat and stable for the dye releasing activator and other additives included in the system; and
4. It is easily synthesized.

Specific examples of preferred image forming dyes which satisfy the above described requirements are described in European Pat. No. 76492.

In the following, specific examples of the preferred dye releasing redox compound are described.

(1)

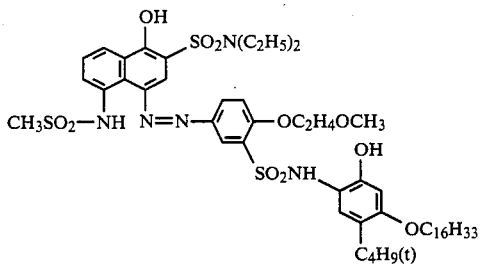

-continued (2)

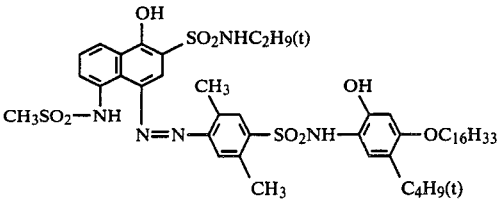

(3)

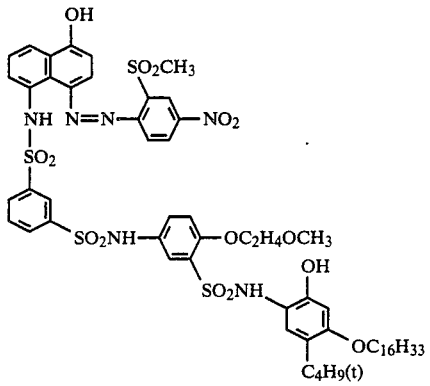

(4)

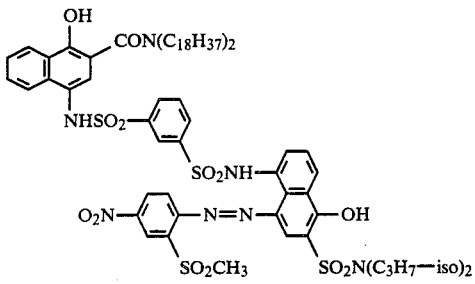

(5)

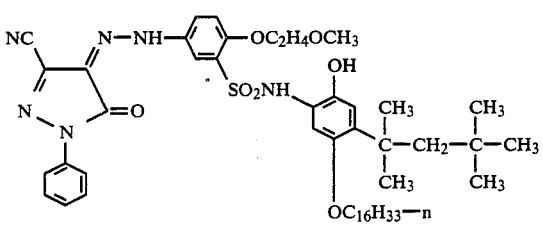

(6)

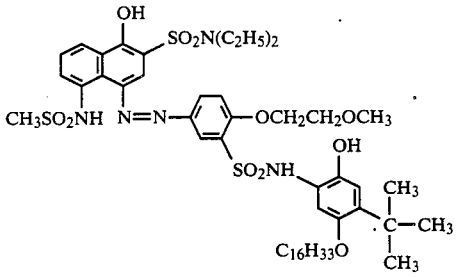

-continued (7)

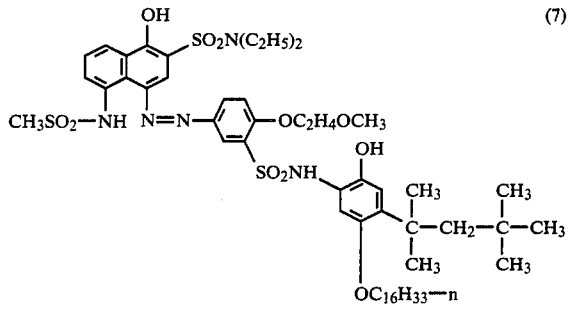

(8)

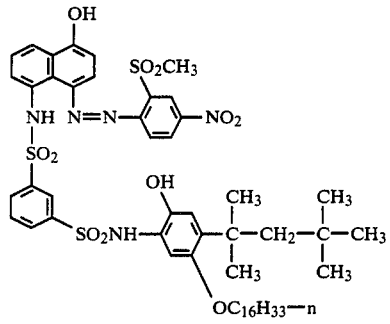

(9)

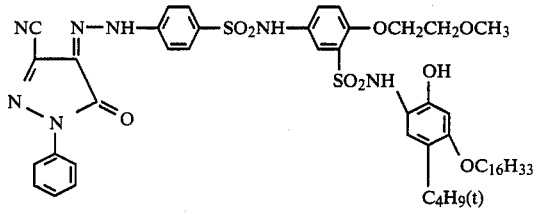

(10)

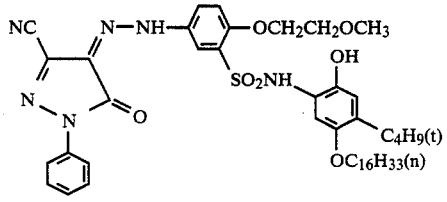

(11)

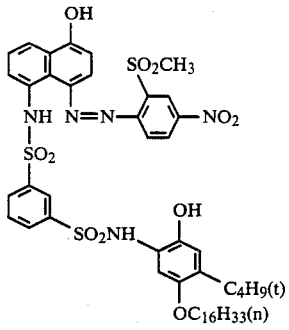

-continued (12)

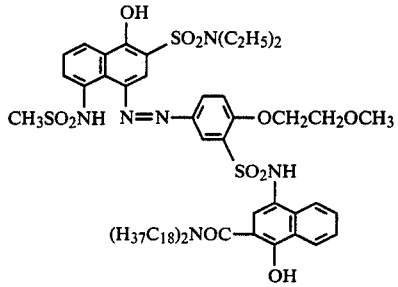

(13)

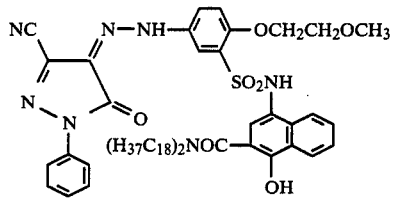

As the dye releasing redox compounds used in this invention, the compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,529, U.S. Published Patent Application B Ser. No. 351,673, U.S. Pat. Nos. 4,135,929 and 4,198,235, Japanese Patent Application (OPI) No. 46730/78, U.S. Pat. Nos. 4,273,855, 4,149,892, 4,142,891, and 4,258,120, etc., are also effective in addition to the above described specific examples.

Further, the dye releasing redox compounds which release a yellow dye, as described, for example, in U.S. Pat. Nos. 4,013,633, 4,156,609, 4,148,641, 4,165,987, 4,148,643, 4,183,755, 4,246,414, 4,268,625 and 4,245,028, Japanese Patent Application (OPI) Nos. 71072/81, 25737/81, 138744/80, 134849/80, 106727/77, 114930/76, etc., can be effectively used in this invention.

The dye releasing redox compounds which release a magneta dye as described, for example, in U.S. Pat. Nos. 3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., can be effectively used in this invention.

The dye releasing redox compounds which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Application (OPI) Nos. 71061/81, 47823/78, 8827/77 and 143323/78, etc., can be effectively used in this invention.

Two or more of the dye releasing redox compounds can be used together. In these cases, two or more dye releasing redox compounds may be used together in order to obtain the same hue or in order to obtain a black color.

The dye releasing redox compounds are suitably used in a range frm 10 mg/m$^2$ to 15 g/m$^2$ and preferably in a range frm 20 mg/m$^2$ to 10 g/m$^2$ (in total).

Herein, the compounds (1) to (5) described above are inclusively referred to as "dye releasing redox compounds".

The reaction of forming a dye image imagewise proceeds especially when an organic silver salt oxidizing agent is present, and the resulting dye image shows a high image density. Accordingly, the presence of the organic silver salt oxidizing agent is an especially preferred embodiment.

In this invention, the desired dye for forming an image can be selected by selecting a combination of various compounds, and therefore various colors can be reproduced. Accordingly, a multicolor image can be obtained by selecting the combination. Thus, the dye image in this invention includes not only a single color image, but also a multicolor image, and the single color image includes those based on mixing of two or more colors.

The dye image formed in the light-sensitive material is finally fixed to the dye fixing material. Although it is not entirely clear why the use of the dye fixing material of this invention leads to an improvement in its peeling property from the light-sensitive material, it is theorized as follows.

Usually, a mordant is used in conventional dye fixing materials. When a polycation such as a quaternary ammonium salt is used as the mordant in order to maintain the fastness of an image fixed to the dye fixing material, the polycation electrostatically interacts with a polyanion as a thickener which is typically used in the emulsion coating of the light-sensitive material and being present on the surface of a protective layer of the light-sensitive material or with the anion speck of gelatin. It is presumably for this reason that when the image is transferred under heat to the dye fixing material, the light-sensitive material and the dye fixing material tend to adhere to each other. This presumption accounts for the defect of the prior art which involves the peeling of the emulsion layer of the light-sensitive material and its adhesion to the surface of the dye fixing material at the time of peeling the light-sensitive material and the dye fixing material from each other.

In contrast, since the especially selected mordant is used in the dye fixing material of this invention, the fastness of the image fixed to the dye fixing material is not impaired, and the electrostatic interaction between the dye fixing material and the light-sensitive material can be minimized. Accordingly, the two materials can be peeled apart easily, and the emulsion layer of the light-sensitive material is prevented from adhering to the dye fixing material and damaging the image.

The polymer used as a mordant in the dye fixing material of this invention has monomeric units of the formula (I) as constituents thereof.

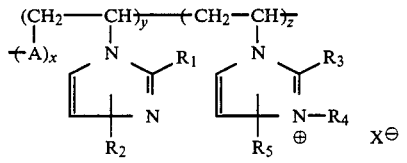

(I)

In the above formula, A represents a vinyl monomer unit having no imidazole or imidazolium group; $R_1$ and $R_3$ represent a hydrogen atom, an alkyl group, an alkyl group substituted by a group capable of forming a coordinate bond with a metal, or a salt thereof; $R_2$ and $R_5$ represent a hydrogen atom, an alkyl group (preferably an alkyl group having from 1 to 12 carbon atoms such as methyl, ethyl, isobutyl, hexyl or decyl which may be substituted by various substituents, such as hydroxymethyl, hydroxyethyl, hydroxypropyl and carboxyalkyl), an aralkyl group (an aralkyl group having from 7 to 10 carbon atoms such as benzyl, phenethyl and p-chlorobenzyl), or an aryl group; $R_4$ represents an alkyl group (preferably an alkyl group having from 1 to 12 carbon atoms such as methyl, ethyl, isobutyl, hexyl or decyl, which may be substituted by various substituents, as hydroxymethyl, hydroxyethyl, hydroxypropyl and carboxyalkyl) or an aralkyl group (an aralkyl group having from 7 to 10 carbon atoms such as benzyl, phenethyl and p-chlorobenzyl); and $X^{\ominus}$ represents an acid radical (such as $Cl^-$, $Br^-$, methane sulfonate, p-toluene sulfonate, metasulfate, nitrate, acetate, sulfate or a like anion); x is from 0 to 80 mole%, preferably from 10 to 80 mole%; y is from 10 to 100 mole%, preferably from 10 to 80 mole%; z is from 0 to 50 mole%, preferably from 0 to 40 mole%, more preferably from 0 to 10 mole%, especially preferably 0%; and y is preferably not less than z.

The vinyl monomer for A may be used any monomer which can be addition-polymerized. Examples of such a monomer include acrylates such as methyl methacrylate, butyl acrylate, butyl methacrylate and ethyl acrylate; vinyl esters such as vinyl acetate; amides such as acrylamide, diacetone allylamide, N-methyl acrylamide and methacrylamide; nitriles such as acrylonitrile and vinylphenyl acetonitrile; ketones such as methyl vinyl ketone, ethyl vinyl ketone and p-vinyl-acetophenone; halides such as vinyl chloride, vinylidene chloride and vinyl benzyl chloride; esters such as methyl vinyl ester, ethyl vinyl ester and vinyl benzyl methyl ester; $\alpha,\beta$-unsaturated acids such as benzoic acid; simple heterocyclic monomers such as vinylpyridine and vinylpyrrolidine; olefins such as ethylene, propylene, butylene, styrene, and substituted styrene; diolefins such as butadiene, 2,3-dimethylbutadiene and the like; and other vinyl monomers well known to one skilled in the art.

The alkyl moiety of $R_1$ and $R_3$ preferably contains from 1 to 12 carbon atoms such as methyl, propyl, isobutyl or hexyl. The alkyl group may be substituted by a group coordinated with a metal, for example, a chelate group or its salt. In this case, the group coordinated with a metal can be defined particularly as a group capable of forming a coordinate bond with a transition metal. It is especially preferred that at least one coordination group can be bonded with a metal to chelate it. Examples of such a group capable of chelating a metal or its salt are hydroxy, carboxyl, cyano, bis(carboxyalkyl)amino such as bis(cyanomethyl)amino, bis(cyanoalkyl)amino such as bis(cyanomethyl)amino, and ammonium or alkali metal salts (such as sodium, potassium, lithium, ammonium or the like salt) of carboxy-substituted alkyl.

The polymeric mordant used in this invention can be easily obtained by polymerizing monomers corresponding to the monomeric units in a conventional manner, and the molecular weight thereof is generally from 10,000 to 200,000 and preferably from 20,000 to 100,000.

Specific examples of the polymeric mordant used in this invention are shown below.

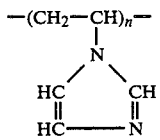

P-1

-continued
P-2
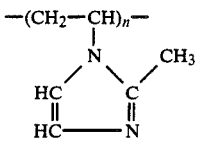
P-3
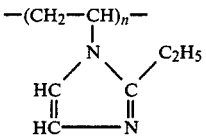
P-4
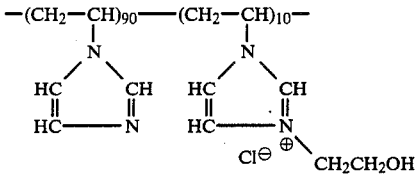
P-5
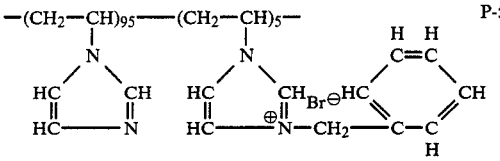
P-6
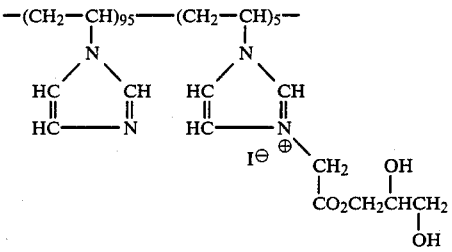
P-7
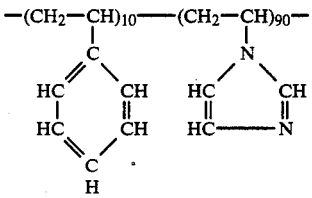
P-8
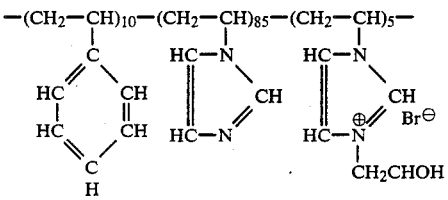
P-9
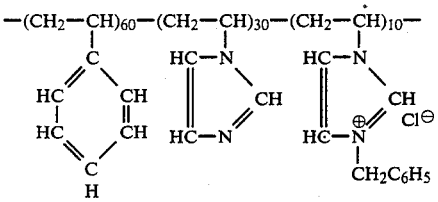
-continued
P-10
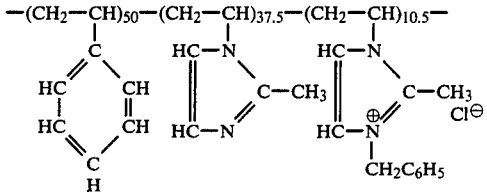
P-11
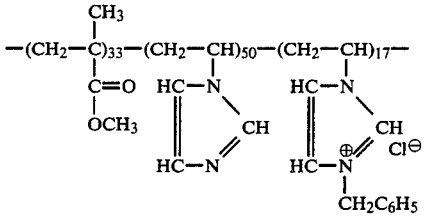
P-12
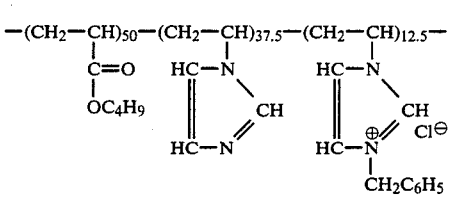
P-13
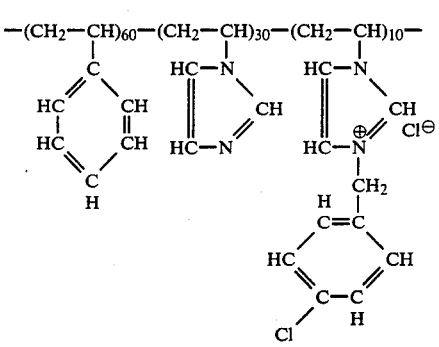
P-14
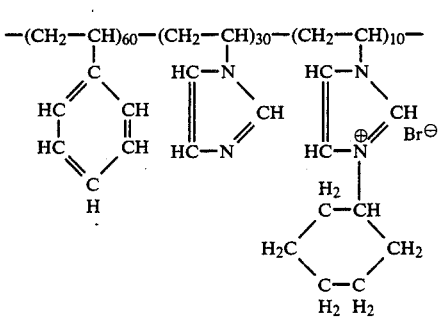
P-15
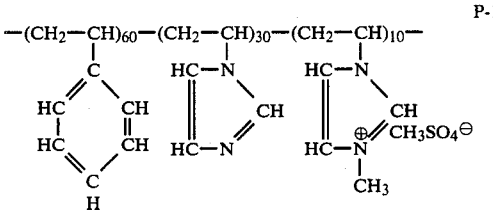

-continued

P-16

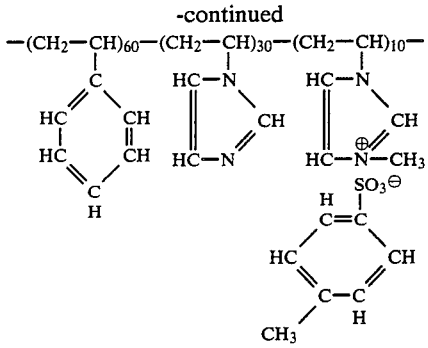

P-17

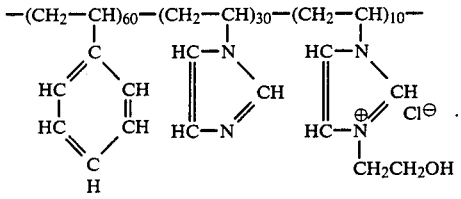

P-18

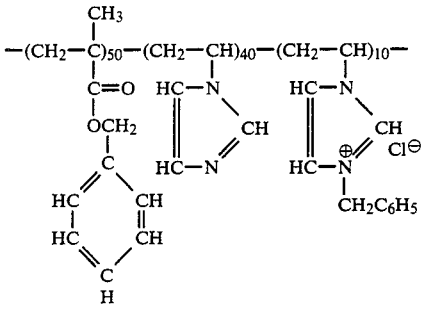

P-19

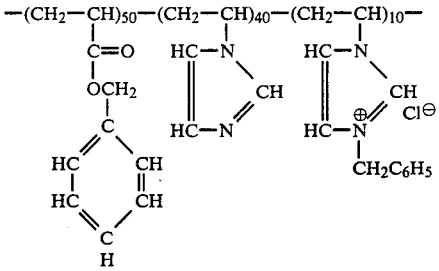

P-20

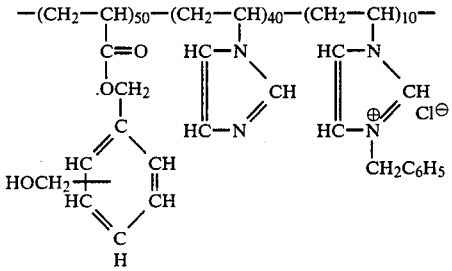

The dye releasing redox compounds used in this invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compounds are dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.) a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of from about 30° C. to 160° C., for example, a lower alkyl acetate such as ethyl acetate, butyl acetate, etc., ethyl propinate, secondary butyl alcohol, methyl isobutyl ketone, $\beta$-ethoxyethyl acetate, methyl acellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese patent application (OPI) No. 59943/76. Moreover, various surface active agents can be used when the dye releasing redox compound is dispersed in a hydrophilic colloid. For this purpose, the surface active agents as described later can be used.

An amount of the organic solvent having a high boiling point used in this invention is 10 g or less per of the dye releasing redox compound used, and preferably 5 g or less.

The silver halide used in this invention includes silver chloride, silver chlorobromide, silver chloroiodide, silver bromide, silver iodobromide, silver chloroiodobromide and silver iodide, etc.

In the embodiment of this invention in which the organic silver salt oxidizing agent is not used together with but the silver halide is used alone, particularly preferred silver halide is silver halide partially containing a silver iodide crystal in its particle. That is, the silver halide of the X-ray diffraction pattern which shows the pattern of pure silver iodide is particularly preferred.

The silver halide used in this invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the PHotographic Process,* Fourth Edition, Chapter 5, pages 149 to 169, Macmillan & Co., 1976.

In the particularly preferred embodiment of this invention, an organic silver salt oxidizing agent is used together. The silver halide used in this case is not always necessary to have the characteristic in that the silver halide contains pure silver iodide crystal in the case of using the silver halide alone. Any silver halide which is known in the art can be used.

As required, a reducing agent can be used in this invention. Useful reducing agents are color developing agents which form images by oxidation coupling. As reducing agents used in heat-developable color light sensitive materials, U.S. Pat. No. 3,531,286 describes p-phenylene-type color developing agents typified by N,N-diethyl-3-methyl-p-phenylendiamine. Other useful reducing agents are aminophenols described in U.S. Pat. No. 3,761,270.

It is possible to use a thermal solvent in this invention. The terminology "thermal solvent" means a non-hydrolyzable organic material which is solid at an ambient temperature (normal temperature) but melts together with other components at temperature of heat processing or less. When the heat development is carried out in the presence of a thermal solvent, a high developing speed and a good image quality can be attained. Preferred examples of thermal solvents include compounds which can act as a solvent for the developing agent and compounds having a high dielectric constant which accelerate physical development of silver salts. Examples of preferred thermal solvents include polyglycols as described in U.S. Pat. No. 3,347,675, for example, polyethylene glycol having a average molecular weight of 1,500 to 20,000, derivatives of polyethylene oxide such as polyethylene oxide oleic acid ester, etc., beeswax, monosterin, compounds having a high dielectric constant which have an —$SO_2$—or —CO— group such as acetamide, succinimide, ethylcarbamate, urea, methylsulfonamide or ethylene carbonate, polar substances as described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl subrate as described in *Research Disclosure,* page 26 to 28 (Dec., 1976), etc.

The role of the thermal solvent in this invention is not entirely clear, but its main role is understood as the facilitation of the diffusion of the reaction molecule species during development.

The light-sensitive silver halide and the organic silver salt oxidizing agent used in this are prepared in the binder as described below. Further, the dye releasing redox compounds is dispersed in the binder described below.

The binder which can be used in this invention can be employed individually or in a combination thereof. A hydrophilic binder can be used as the binder according to this invention. The typical hydrophilic binder is a transparent or translucent hydrophilic colloid, examples of which include a natural substance, for example, protein such as gelatin, a gelatin derivative, a cellulose derivative, etc., a polysccharide such as starch, gum arabic, pullulan, dextrin etc., and a synthetic polymer, for example, a water-soluble polyvinyl compound such as polyvinyl alcohol polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dye or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

In this invention, various dye releasing activators can be used by various methods, for example by including them into any one layer of the light sensitive material or any one layer of the dye fixing material. The dye forming activators represent compounds which promote the oxidation-reduction reaction of the light sensitive silver halide and/or organic silver salt oxidizing agent with the dye releasing redox compounds. When a dye releasing redox compound is used in the light sensitive material, the dye releasing activator nucleophilically acts on the dye releasing redox compound oxidized by the dye releasing reaction which takes place subsequent to the oxidation-reduction reaction, and thus promotes the dye releasing of the dye releasing redox compound. Beses or base precursors may be used as such dye releasing activators. In this invention, the use of such dye releasing activators is especially advantageous to the promotion of the reaction. The base precursors are especially preferred because they can prevent changes of the light sensitive material during storage. The base procursors, as used herein, release a basic component upon heating. The basic component to be released may be an inorganic or organic base to be described below.

As the base precursors, substances which cause some reaction by heating to release a base, such as salts of an organic acid which is decarboxylated by heating to cause decomposition and a base, or compounds which are decomposed by Lossen rearrangement of Beckman rearrangement to release an amine, are used.

Preferred base precursors, include precursors of the below described bases. Specific examples include salts of thermally decomposing organic acid such as trichloroacetic acid, propiolic acid, cyanoacetic acid, sulfonylacetic acid or acetacetic acid, etc., and salts of 2-carboxycarboxamide described in U.S. Pat. No. 4,088,496, etc.

Preferred examples of the base precursors are described. Examples of compounds which are believed to release a base by decarboxylation of the acid part are described below.

As trichloroacetic acid derivatives, there are guanidine trichloroacetic acid, piperidine trichloroacetic acid, morpholine trichloroacetic acid, p-toluidine trichloroacetic acid and 2-picoline trichloroacetic acid, etc.

In addition, base precursors described in British Pat. No. 998,945, U.S. Pat. No. 3,220,846 and Japanese patent application (OPI) No. 22625/75, etc. can be used.

As substances besides trichloroacetic acids, there are 2-carboxycarboxamide derivatives described in U.S. Pat. No. 4,088,496, α-sulfonylacetate derivatives described in U.S. Pat. 4,060,420 and salts of propiolic derivatives and bases described in Japanese patent application No. 55700/83, etc. Salts using alkali metal and alkaline earth metal as a base component besides organic bases are also available and described in Japanese patent application No. 69597/83.

As other procursors, hydroxamic carbamates described in Japanese patent application No. 43860/83 utilizing Lossen rearrangement and aldoxime carbamates described in Japanese patent application No. 31614/83 which form nitrile, etc. are available.

Further, amineimides described in *Research Disclosure* No. 15776, May 1977, and aldonic amides described in Japanese patent application (OPI) 22625/75 are suitably used, because they form a base by decomposition at a high temperature.

The releasing of a basic component by the aforesaid base precursors upon heating can be ascertained by various methods. For example, such analytical means as gas chromatography or liquid chromatography may be used. It is also possible to use a method which comprises heating the light sensitive material, then applying a small amount of water to it, and measuring the pH on the film surface.

It is advantageous to use a compound represented by the formula described below in the heat-developable color photographic material in order to accelerate development and accelerate release of a dye.

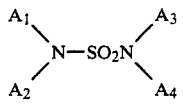

In the foregoing formula $A_1$, $A_2$, $A_3$ and $A_4$, which may be the same or different, each represents a hydrogen atom or a substituent group selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

Specific examples of the compounds include $N_2NSO_2NH_2$, $H_2NSO_2N(CH_3)_2$, $H_2NSO_2N(C_2H_5)_2$, $H_2NSO_2NHCH_3$, $H_2NSO_2N(C_2H_4OH)_2$, $CH_3NHSO_2NHCH_3$,

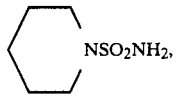

etc.

The above described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in this invention in order to accelerate the dye releasing reaction.

The water releasing compound means a compound which releases water by decomposition during heat development. These compounds are particularly known in the field of printing of fabrics, and $NH_4FE(SO_4)_2.12H_2O$ etc., as described in Japanese patent application (OPI) No. 88386/75 are useful.

A support use in this invention is a material which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. The polyesters described in U.S. Pat. Nos. 3,634,089 and 3,725,070 are preferably used. Further the polyethylene terephthalate film is more preferably used.

A coating solution used in this invention may be prepared by separately forming a silver halide and an organic metal salt oxidizing agent, and mixing them prior to use. However it is also effective to mix the two in a ball mill for a long period of time. Another effective method comprises adding a halogen-containing compound to the prepared organic silver salt oxidizing agent, and forming a silver halide by the reaction of the halogen-containing compound with silver in the organic silver salt oxidizing agent.

Methods of preparing these silver halide and organic silver salt oxidizing agents and manners of blending them are described in *Research Disclosure,* No. 17029, Japanese patent application (OPI) Nos. 32928/75 and 42529/76, U.S. Pat. No. 3,700,458, and Japanese patent application (OPI) Nos. 13224/74 and 17216/75.

A suitable coating amount of the light-sensitive silver halide and the organic silver salt oxidizing agent employed in this invention is in a total of from 50 mg/m$^2$ to 10 g/m$^2$ (calculated as an amount of silver).

The photographic emulsion layer and other hydrophilic colloid layers in the light-sensitive material of this invention may contain various surface active agents for various purposes, for example, as coating aids or for prevention of electrically charging, improvement of lubricating property, emulsification, prevention of adhesion, improvement of photographic properties (for examle, acceleration of development, rendering hard tone or sensitization), etc.

For example, it is possible to use nonionic surface active agents such as saponin (steriod), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acidds, aminoalkylsulfuric acid esters or phosphoric acid esters, alkylbetaines, amine oxides, etc.; and cationic surface active agents such as alkylamine salts, alphatic or aromatic quaternary ammonium salts, heterocyclic quarternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated in the light-sensitive material. It is particularly preferred that the molecule contains 5 or more of the recurring units of ethylene oxide.

The nonionic surface active agents capable of satisfying the above described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), the *Surface Active Ethylene Oxide Adducts,* (edited by Scoufeldt N. Pergamon Press, 1969). Among the nonionic surface active agents described in the above mentioned references, those capable of satisfying the above described conditions are preferably employed in connection with this invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

Further, in this invention, it is possible to use a compound which activates development while simultaneously stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German patent application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylene-bis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In this invention, though it is not so necessary to further incorporate substances or dyes for preventing irradiation or halation in the light-sensitive material, because the light-sensitive material is colored by the dye releasing redox compound, it is possible to add filter dyes or light absorbing materials, etc., as described in Japanese patent publication No. 3692/73 and U.S. Pat. Nos. 3,253,921, 2,527,583 and 2,956,879, etc., in order to further improve shapeness. It is preferred that these dyes have a thermal bleaching property. For example, dyes as described in U.S. Pat. Nos. 3,769,019, 3,745,009 and 3,615,432 are preferred.

The light-sensitive material used in this invention may contain, if desired, various additives known for the heat-developable light-sensitive materials and may have a layer other than the light-sensitive layer, for example, an antistatic layer, an electrically conductive layer, a protective layer, an intermediate layer, an antihalation layer, a peeling layer, etc.

Examples of various additives include those described in *Research Disclosure*, Vol. 170, No. 17029 (June, 1978), for example, plasticizers, dyes for improving shapness, antihalation dyes, sensitizing dyes, matting agents, surface-active agents fluorescent whitening agents and fading preventing agent, etc.

If desired, two or more layers may be applied at the same time by the method as described in U.S. Pat. No. 2,761,791 and British Patent No. 837,095.

In this invention, the latent image obtained after exposure of the light sensitive material can be developed by heating the material at a moderately elevated temperature of, for example, about 80° to about 250° C., for a period of about 0.5 second to about 3000 seconds. By increasing or decreasing the heating time, the temperature may be adjusted higher or lower within the above range. Temperatures in the range of about 110° to about 160° C. are especially useful. Heating may be carried out by conventional heating means such as a hot plate, an iron, a hot roller, a heat generator using carbon or titanium white, or the like.

Since in this invention the dye image formed in the photosensitive layer of the light sensitive material is an image by the hydrophilic dye, the image can be transferred to the dye fixing layer in a hydrophilic atmosphere. When this step of dye fixation is carried out in the dry state, it is necessary to transfer the image formed by the mobile hydrophilic dye to the dye fixing layer at high temperatures in the presence of a hydrophilic thermal solvent. At this time, the transfer of the mobile dye may be started simultaneously with the formation of the dye image or after the formation of the dye image. Accordingly, heating for this transfer may be carried out during or after the heat development. Heating during the heat development means that heating for development also acts as heating for the transfer of the formed dye. Since the optimum temperature for development and the optimum temperature for dye movement and the heating times required for them do not always coincide, it is possible to preset these temperatures independently from each other.

By the terminology "under a high-temperature state under which the hydrophilic thermal solvent exists" is meant the state having an atmospheric temperature higher than 60° C. under which the hydrophilic thermal solvent exists.

Since the heating temperature for the transfer of the dye is from 60° C. to 250° C. from the viewpoint of the shelf life, the workability, etc., of the light-sensitive materials, substances capable of exhibiting the action as the hydrophilic thermal solvent at the temperature range can be properly selected. It is as a matter of course necessary that the hydrophilic thermal solvent quickly assists the transfer of dye by heating but considering the heat resistance, etc., of the light-sensitive materials together, the melting point required for the hydrophilic thermal solvent is from 40° C. to 250° C., preferably from 40° C. to 200° C., and more preferably from 40° C. to 150° C.

"The hydrophilic thermal solvent" in this invention is defined to be a compound which is in a solid state at ambient temperature but becomes in a liquid state by heating and in which the inorganisity/organisity value is larger than 1 and the solubility in water at ambient temperature is higher than 1. In this case, the terms organisity and the inorganisity are used in same sense as described in *Kagaku no Ryoiki* (*The Domain of Chemistry*), Vol. 11, 719 (1957).

Since the hydrophilic thermal solvent has a role of assisting the transfer of the hydrophilic dye, it is preferred that the thermal solvent be a compound capable of acting as a solvent for the hydrophilic dye.

In general, it is experimentally known that in a solvent preferred for dissolving an organic compound, the inorganisity/organisity value of the solvent is similar to the inorganisity/organisity value of the organic compound. On the other hand, the inorganisity/organisity value of the dye releasing compound used in this invention is about 1 and the inorganisity/organisity value of the hydrophilic dye released from the dye releasing compound is larger than 1, preferably larger than 1.5 and more preferably larger than 2. It is preferred that the hydrophilic thermal solvent can transfer the hydrophilic dye only and cannot transfer the dye releasing compound and hence it is necessary that the inorganisity/organisity value of the hydrophilic thermal solvent is larger than the inorganisity/organisity value of the dye-releasing compound. In other words, it is a necessary condition that the inorganisity/organisity value of the hydrophilic thermal solvent is larger than 1, and preferably larger than 2.

On the other hand, from the viewpoint of the size of molecule, it is considered to be preferred that a molecule capable of transferring without obstructing the transfer of a dye exists around the transferring dye. Accordingly, it is preferred that the molecular weight of the hydrophilic thermal solvent in this invention is smaller and is less than about 200, more preferably less than about 100.

It is sufficient that the hydrophilic thermal solvent used in this invention can substantially assist the transfer of the hydrophilic dye formed by the heat development onto the dye-fixing layer. Therefore, the hydrophilic thermal solvent may be incorporated in the dye-fixing layer as well as in the light-sensitive layer, etc., of the light-sensitive material, in both the dye-fixing layer and light-sensitive layer, or an independent layer containing the hydrophilic thermal solvent may be formed in the dye-fixing material having a dye-fixing layer. From the viewpoint of increasing the transfer efficiency of the dye onto the dye-fixing layer, it is preferred that the hydrophilic thermal solvent be incorporated in the dye-fixing layer and/or a layer adjacent to the dye-fixing layer.

The hydrophilic thermal solvent is usually dispersed in a binder with dissolved in water but may be dispersed with dissolved in an alcohol such as methanol, ethanol, etc.

The coating amount of the hydrophilic thermal solvent used in this invention generally from 5 to 500% by weight, preferably from 20 to 200% by weight, and more preferably from 30 to 150% by weight of the total coating amount of the layers of the light-sensitive material and/or the dye-fixing material.

Examples of the hydrophilic thermal solvent used in this invention are ureas, pyridines, amides, sulfonamides, imides, alcohols, oximes, and other heterocyclic compounds.

Generally, the photosensitive layer and the dye fixing layer may be formed on the same support, or by forming them on different supports, a light-sensitive material and a dye fixing material may be formed. The dye fixing layer may be peeled off from the photosensitive layer. For example, the material is imagewise exposed and uniformly heat-developed and thereafter the dye fixing layer or the photosensitive layer may be peeled off. When the light-sensitive material having the photosensitive layer coated on a support and the dye fixing material having the dye fixing layer coated on a support are prepared separately, it is possible to expose the light-sensitive material imagewise, heat it uniformly, and superimpose the dye fixing material on it, thereby transferring the mobile dye to the dye fixing layer. Alternatively, the photosensitive layer of the light-sensitive material is imagewise exposed, then the dye fixing layer is superimposed on it, and the assembly is uniformly heated.

The dye fixing layer may contain a white color reflecting layer. For example, a layer of titanium dioxide dispersed in gelatin may be provided on the mordant layer on a transparent support. The titanium dioxide layer forms a white non-transparent layer, and by viewing the transferred dye image from the side of the transparent support, a reflection-type color image is obtained.

Intimate contact between the light-sensitive material and the dye fixing material can be effected by a conventional method, for example, by using a press roller. To make the contact sufficient, heating may be done during the contacting.

In this invention, there can be employed a dry dye fixing step in which heat development is carried out after or during imagewise exposure, then the surface of the light-sensitive material is brought into intimate contact with the dye acceptive surface of the dye fixing material, and the dye formed imagewise is transferred to the dye fixing material at high temperatures in the presence of a hydrophilic thermal solvent. Heating for movement of the dye can be effected by using the same heating means as described above for the heat development.

One particularly preferred embodiment in the case of using the dry dye fixing step is that the dye fixing layer as a constituent of the dye fixing material of this invention mainly includes a dye mordant for dye fixation and the hydrophilic thermal solvent for aiding in the movement of the dye and as required further contains a base and/or a base precursor for promoting the dye forming reaction, etc., a development stopping agent and/or an antifoggant for inhibiting image fogging, and further a binder for binding them.

In order to increase the quality of the dye image transferred to the dye fixing layer, it is useful to include the base and/or the base precursor as a dye forming activator into any one of the layers constituting the dye fixing material. It is preferred in this case to include the dye forming activator in the dye fixing layer or a layer provided above the dye fixing layer, such as a protective layer, because it can give a dye image having a sufficient density and being clear and sharp. Examples of the dye forming activator may be the same as those described hereinabove for the light-sensitive material.

The base precursor in this invention can be used in a wide range of amounts. The suitable amount is not more than 50% by weight, preferably 0.01 to 40% by weight, based on the weight of the coated surface of the dye fixing layer. The bases or the base precursors may be used singly or as a mixture of two or more.

The base and/or the base precursor is dissolved in water or alcohols and then dispersed in the dye fixing layer. It may be dispersed by the method described in U.S. Pat. No. 2,322,027 which uses an organic solvent having a high boiling point. Alternatively, it may be dispersed in the dye fixing layer after it is dissolved in an organic solvent having a boiling point of about 30° to about 160° C., for example, a lower alkyl acetate such as ethyl acetate or butyl acetate, ethyl propionate, secondary butyl alcohol, methyl isobutyl ketone, β-ethoxyethyl acetate, methyl cellosolve acetate, and cyclohexane.

Examples of high boiling organic solvents that can be used include alkyl phthalates such as dibutyl phthalate and dioctyl phthalate, phosphates such as diphenyl phosphate, triphenyl phosphate, tricresyl phosphate and dioctylbutyl phosphate, citrates such as tributyl acetylcitrate, benzoates such as octyl benzoate, alkylamines such as diethyllaurylamide, fatty acid esters such as dibutoxyethyl succinate and dioctyl azelate, and trimesates such as tributyl trimesate. The above high boiling organic solvents may be used as a mixture with low boiling organic solvents. The dispersing methods using polymers as described in Japanese Patent Publication No. 39853/1976 and Japanese Patent Application (OPI) No. 59943/1976 may also be used.

The dye fixing layer in accordance with this invention can be one or a plurality of layers, and contains a dye mordant for dye fixation. The base and/or the base precursor is used as dispersed in a layer containing the dye mordant. In another form, the base and/or the base precursor can be used as dispersed in a binder of a layer adjacent to the layer containing the dye mordant. Various mordants can be used, and especially useful mordants are the polymers of formula (I) as described hereinabove. The amount of the polymeric mordant of this invention is generally from 0.2 to 15 g/m$^2$, preferably from 0.5 to 8 g/m$^2$.

The layer containing the mordant represented by formula (I) used in this invention is hardened by the copresence of a metal ion, and the transferability of the image to the dye fixing material and the color fastness of the resulting colored image are improved. Accordingly, the dye fixing material of this invention preferably has a layer containing a metal ion. The metal ion may be contained in the layer containing the dye mordant or a layer adjacent to the layer containing the dye mordant. It is preferred that a metal ion be contained in a layer adjacent to the layer containing the dye mordant and diffused to the layer containing the dye mordant. Preferred metal ions are, for example, $Zn^{2+}$, $Ni^{2+}$, $Mn^{2+}$, $Al^{3+}$ and $Co^{3+}$. Especially preferred is $Zn^{2+}$. The amount of the metal ion is generally from 0.01 to 5.0 g/m$^2$, preferably from 0.1 to 1.5 g/m$^2$.

The polymeric mordant and the base and/or the base precursor may be dispersed in binders described below. These binders may be used singly or in combination. Hydrophilic binders are preferred. Transparent or semi-transparent hydrophilic colloids are typical of the hydrophilic binders. They include, for example, proteins such as gelatin, gelatin derivatives and cellulose derivatives; natural substances, for example, polysaccharides such as starch, gum arabic, dextrin and pullulan; synthetic polymers, for example, water-soluble polyvinyl compounds such as polyvinyl alcohol, polyvinyl pyrrolidone and acrylamide polymer. Another synthetic polymeric compound is a dispersed vinyl compound, which in the form of a latex, increases the dimensional stability of the photographic material.

For the transfer of the dye from the photosensitive layer to the dye fixing layer, a dye transfer aid may be used. Water or a basic aqueous solution containing sodium hydroxide, potassium hydroxide, or an inorganic alkali metal salt may be used as a dye transfer aid. A low boiling solvent such as methanol, N,N-dimethylformamide, acetone or diisobutyl ketone or a mixture of the low boiling solvent with water or a basic aqueous solution may also be used. The dye transfer aid may be used by wetting the image acceptive layer with it, or may be included in the material as water of crystallization or as microcapsules.

When the dye fixing layer is located on the surface, a protective layer may, as required, be further formed on it. Protective layers generally used in light-sensitive materials may be used as such a protective layer. When the dye fixing layer is provided in the dye fixing material separately from the light-sensitive material, it is preferred to impart hydrophilic property also to the protective layer in order not to inhibit the transfer of the hydrophilic dye.

The same heating means as used in heat development may be employed to move the dye.

In order to increase the quality of the dye image transferred to the dye fixing layer, it is preferred to prevent the increase of fogging by the occurrence of unnecessary development during the transfer. For this purpose, it is especially effective to include a compound which reacts with the silver halide and/or can have the silver halide adsorbed thereon as a development stopping agent and/or an antifoggant in any one of the layers constituting the dye fixing material. Such a compound is preferably included in the dye fixing layer or a layer provided above the dye fixing layer, such as a protective layer, because it rapidly inhibits excessive development of the photosensitive layer during transfer of the dye by heating and a sharp and clear dye image can be obtained. Such a compound is, for example, a nitrogen-containing heterocyclic compound, preferably a 5- or 6-membered heterocyclic compound containing a nitrogen atom.

More preferred examples of the nitrogen-containing 5- or 6-membered heterocyclic compounds and their condensed rings can be represented by following general formulae.

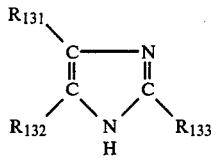
(VIII-1)

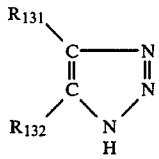
(VIII-2)

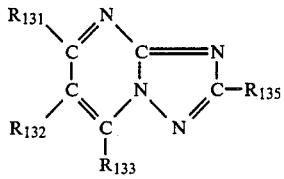
(VIII-3)

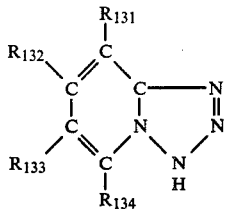
(VIII-4)

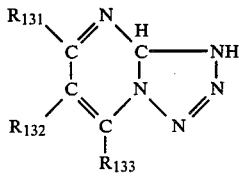
(VIII-5)

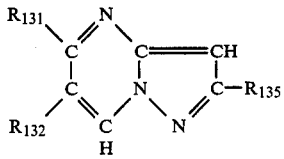
(VIII-6)

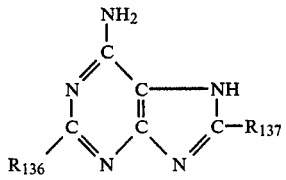
(VIII-7)

-continued (VIII-8)

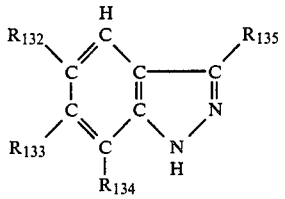

(VIII-9)

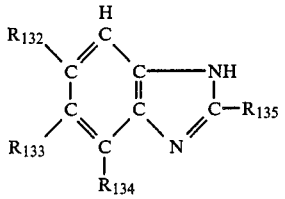

(VIII-10)

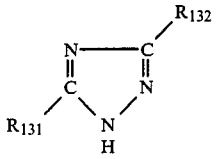

(VIII-11)

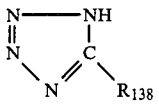

(VIII-12)

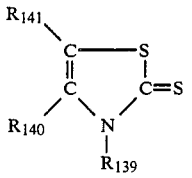

(VIII-13)

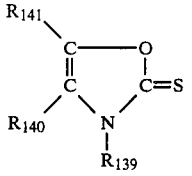

In general formulae (VIII-1) to (VIII-13), each of $R_{131}$, $R_{132}$, $R_{133}$ and $R_{134}$ represents a hydrogen atom, alkyl, aralkyl, alkenyl, alkoxy, aryl, —NRR′, —COOR, —$SO_3M^*$, —CONRR′, —$NHSO_2R$, —$SO_2NRR'$, —$NO_2$, a halogen atom, —CN or —OH (where R and R′ represents a hydrogen atom or an alkyl, aryl or aralkyl group, and M* represents a hydrogen atom or an alkali metal atom).

When $R_{131}$ and $R_{132}$ are alkyl group, they may be bonded to each other to form an alicyclic ring.

$R_{135}$ represents a hydrogen atom, an alkyl group having 1 to 5 carbon atoms, or the group—S—R″ (wherein R″ represents a hydrogen atom or an alkyl, aryl or aralkyl group).

$R_{136}$ represents a hydrogen atom or an alkyl group.

$R_{137}$ represents a hydrogen atom or an alkyl or aryl group.

$R_{138}$ represents an alkyl, aryl, benzyl or pyridyl group.

$R_{139}$ represents an alkyl, alkenyl or aryl group.

$R_{140}$ and $R_{141}$ represent an alkyl, alkenyl or aryl group. When $R_{140}$ and $R_{141}$ are both alkyl groups, they may be bonded to each other to from an aromatic ring.

In the present invention, it is especially preferred to use a nitrogen-containing heterocyclic compound having a mercapto group which is represented by the formula (IX).

(IX)

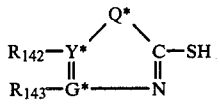

In the formula (XVI), Q* represents an oxygen or sulfur atom or the group —NR‴ (wherein R‴ represents a hydrogen atom, an alkyl group, an unsaturated alkyl group or a substitubed or unsubstituted aryl or aralkyl group); each of Y* and G* represents a carbon or nitrogen atom; and each of $R_{142}$ and $R_{143}$ represents a hydrogen atom, an alkyl group, an unsaturated alkyl group, a substituted or unsubstituted aryl group, a substituted or unsubstituted aralkyl group, the group —SR⁗ or the group —$NH_2$ (wherein R⁗ represents a hydrogen atom, an alkyl group, an aryl group, an aralkyl group, an alkylcarboxylic acid group or its alkali metal salt, or a an alkylsulfonic acid group or its alkali metal salt), when both Y* and G* are carbon atoms, $R_{142}$ and $R_{143}$ may form a substituted or unsubstituted aromatic ring.

Thiourea and its derivative represented by the following general formula (X) are also very effective for stopping excessive development or preventing fogging by reaction and/or adsorption thereon with the silver halide.

(X)

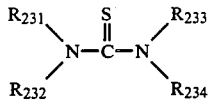

$R_{231}$ to $R_{234}$ may be the same or different, and each represents a hydrogen atom, a substituted or unsubstituted alkyl group (such as methyl, ethyl, cyclohexyl, hydroxyethyl, carboxypentyl or diethylaminopropyl), a substituted or unsubstituted alkenyl group (such as allyl), a substituted or unsubstituted aralkyl group (such as benzyl), a substituted or unsubstituted aryl group (such as phenyl, p-tolyl or m-methoxyphenyl), a nitrogen-containing heterocyclic group (such as pyridyl, quinolyl, thiazolyl, thiadiazolyl, oxazoyl, benzothiazolyl, benzoxazolyl, imidazolyl, benzimidazolyl, triazolyl, morpholyl, or benzotriazolyl), or an acyl group (such as methoxy, ethoxy, or benzoyl).

$R_{231}$ and $R_{232}$ or $R_{233}$ and $R_{234}$ may be bonded to each other to form a 5-, 6- or 7-membered ring containing a carbon, nitrogen, oxygen or sulfur atom, and $R_{231}$ and $R_{233}$ or $R_{232}$ and $R_{234}$ may be bonded to each other to form a 5-, 6- or 7-membered ring containing a carbon, nitrogen, oxygen or sulfur atom.

Typical examples of the compounds represented by the above general formulae are shown below.

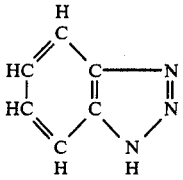
(X-1)
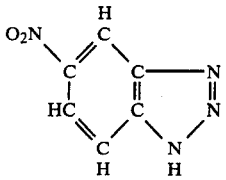
(X-2)
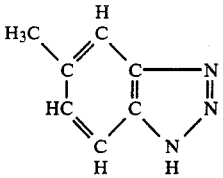
(X-3)
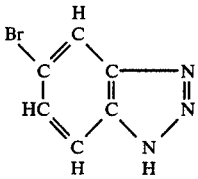
(X-4)
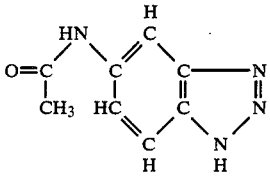
(X-5)
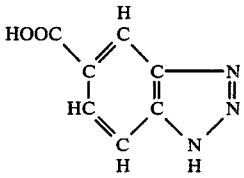
(X-6)
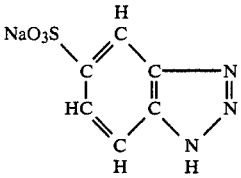
(X-7)
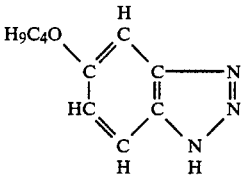
(X-8)
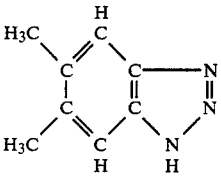
(X-9)
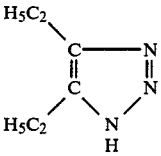
(X-10)
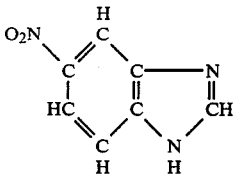
(X-11)
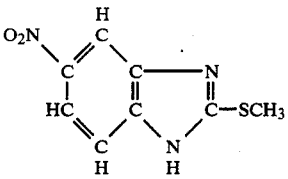
(X-12)
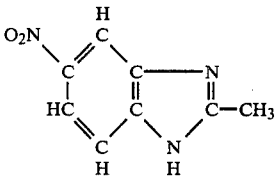
(X-13)
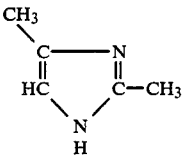
(X-14)
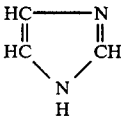
(X-15)
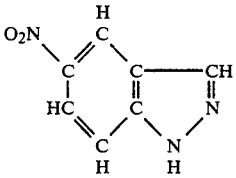
(X-16)
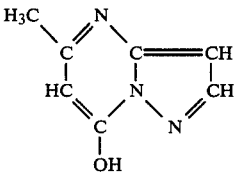
(X-17)
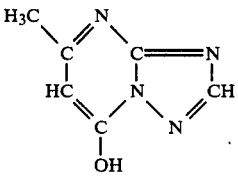
(X-18)

-continued
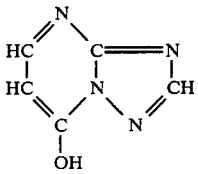
(X-19)
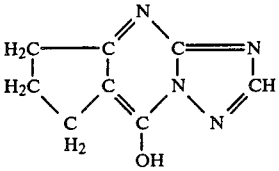
(X-20)
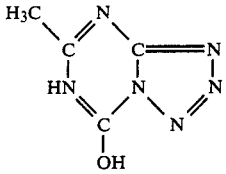
(X-21)
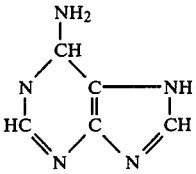
(X-22)
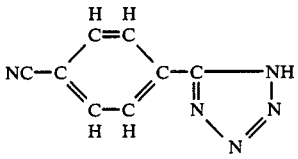
(X-23)
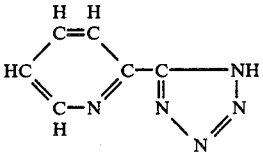
(X-24)
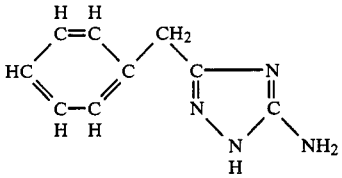
(X-25)
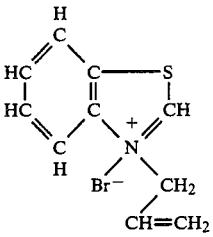
(X-26)
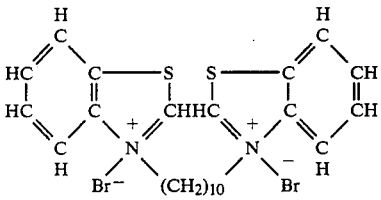
(X-27)
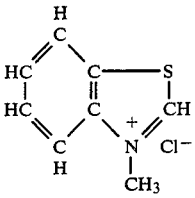
(X-28)
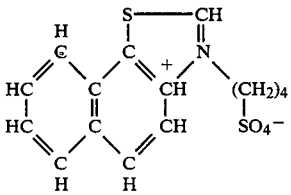
(X-29)
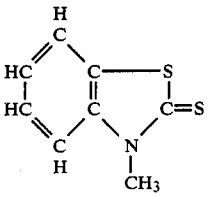
(X-30)
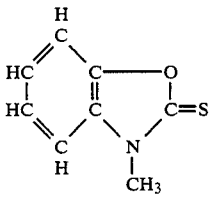
(X-31)
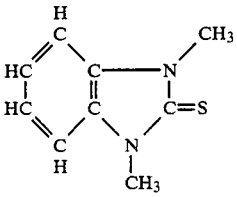
(X-32)
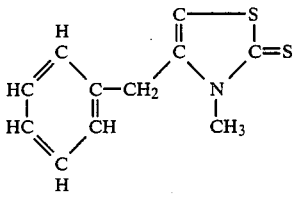
(X-33)
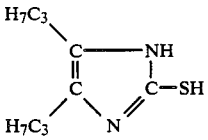
(X-34)

-continued
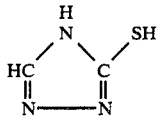
(X-35)
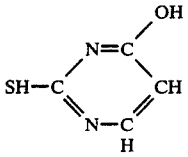
(X-36)
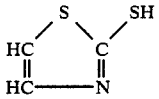
(X-37)
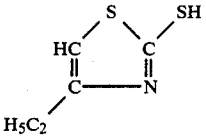
(X-38)
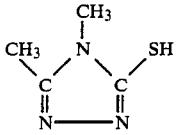
(X-39)
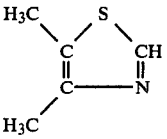
(X-40)
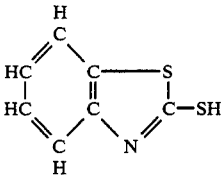
(X-41)
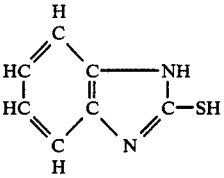
(X-42)
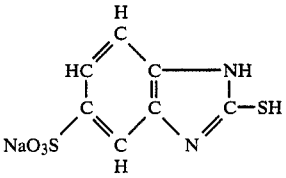
(X-43)
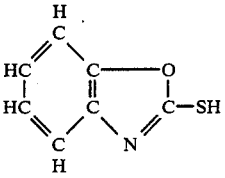
(X-44)
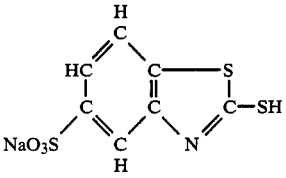
(X-45)
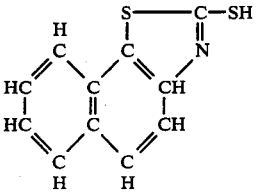
(X-46)
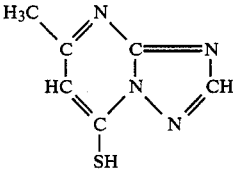
(X-47)
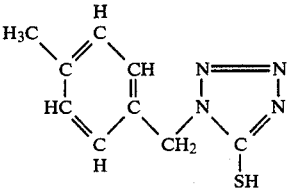
(X-48)
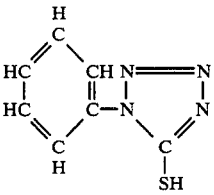
(X-49)
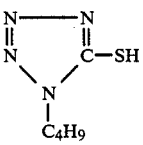
(X-50)

-continued
(X-51)
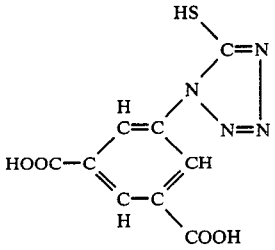
(X-52)
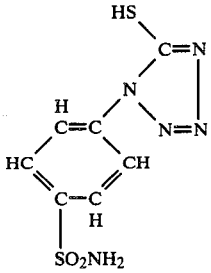
(X-53)
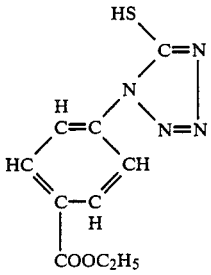
(X-54)
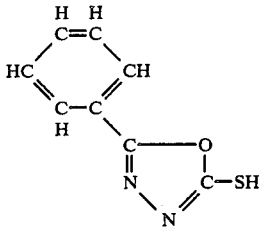
(X-55)
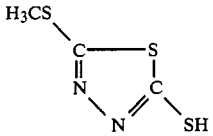
(X-56)
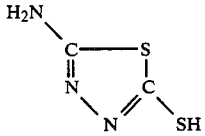
(X-57)
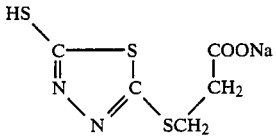
(X-58)
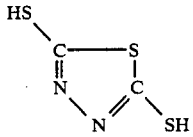
(X-59)
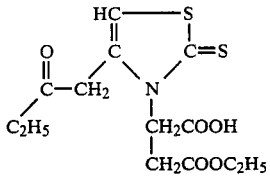
(X-60)
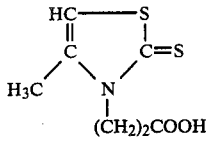
(X-61)
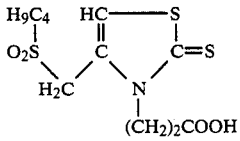
(X-62)
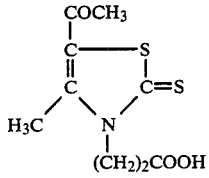
(X-63)
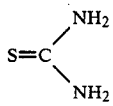
(X-64)
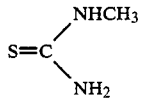
(X-65)
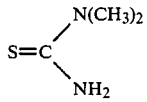
(X-66)
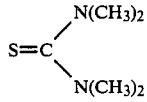
(X-67)
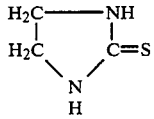
(X-68)
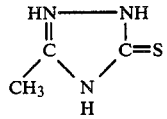

-continued

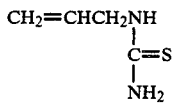

(X-69)

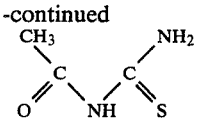

(X-70)

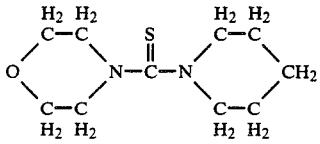

(X-71)

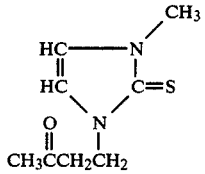

(X-72)

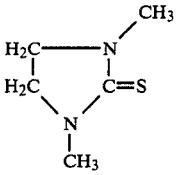

(X-73)

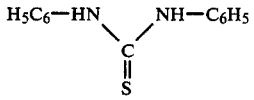

(X-74)

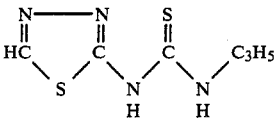

(X-75)

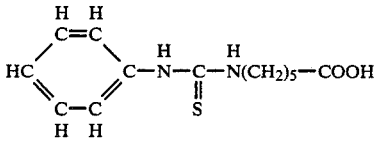

(X-76)

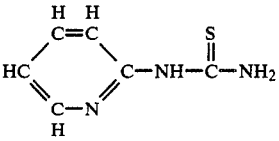

(X-77)

The support for the dye fixing material may be selected from those supports described above which are used in the light sensitive materials. Preferably, the support is a polymeric material which has heat resistance to heating effected for development or dye transfer.

Examples of organic polymeric materials used in the support of the dye fixing material of this invention include polystyrene having a molecular weight of 2,000 to 85,000, polystyrene derivatives having substituent groups with not more than 4 carbon atoms, polyvinyl cyclohexane, polydivinylbenzene, polyvinylpyrrolidine, polyvinylcarbazole, polyallybenzene, polyvinyl alcohol, polyacetals such as polyvinyl formal and polyvinyl butyral, polyvinyl chloride, chlorinated polyethylene, polytrifluoroethylene, polyacrylonitrile, poly-N,N-dimethylallylamide, polyacrylates having a p-cyanophenyl group, a pentachlorophenyl group and a 2,4-dichlorophenyl group, polyacrylchloroacrylate, polymethyl methacrylate, polyethyl methacrylate, polypropyl methacrylate, polyisopropyl methacrylate, polyisobutyl methacrylate, polytertiary butyl methacrylate, polycyclohexyl methacrylate, polyethylene glycol dimethacrylate, poly-2-cyano-ethyl methacrylate, polyesters such as polyethylene terephthalate, polysulfnone, bisphenol A polycarbonate, polycarbonates, polyanhydrides, polyamides and cellulose acetate. The synthetic polymers described in *Polymer Handbook*, 2nd edition (edited by J. Brandrup and E. H. Immergut, published by John Wiley and Sons, Inc.) are also useful. These polymeric substances may be used singly or a plurality of them may be used in the form of a copolymer.

Especially useful supports are films of cellulose acetate such as cellulose triacetate or diacetate, films of polyamides derived from a combination of heptamethylenediamine and terephthalic acid, a combination of fluorenedipropylamine and adipic acid, a combination of hexamethylenediamine and diphenic acid, and a combination of hexamethylenediamine and isophthalic acid, films of polyesters derived from a combination of diethylene glycol and diphenylcarboxylic acid and a combination of bis-p-carboxyphenoxybutane and ethylene glycol, a polyethylene terephthalate film and a polycarbonate film. These films may be modified. For example, polyethylene terephthalate films modified by modifirs such as cyclohexane dimethanol, isophthalic acid, methoxypolyethylene glycol or 1,2-dicarbomethoxy-4-benzenesulfonic acid are effective.

In the photographic light-sensitive material and the dye fixing material of this invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylol-urea, methylol dimethylhydrantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used alone or as a combination thereof.

The dye fixing material of this invention may be used whether the step of fixing a dye image is carried out by the dry method or the wet method. In either case, the peeling property of the dye fixing material from the light-sensitive material is good, and an excellent dye image can be obtained. This effect is especially remarkable when the layer containing the polymer having monomeric units represented by general formula (I) is provided on the uppermost portion of the dye fixing material. The image obtained by using the dye fixing material of this invention has better fading resistance after storage in dark places than in the prior art. The fading resistance after storage in dark places is further improved when the aforesaid polymer forms a chelate with a metal ion. Accordingly, when a completely dry processing is performed without supplying a solvent from outside in the entire steps from exposure, heat development to dye fixation, the dye image has very good quality and storage stability. Hence, the dye fixing material of this invention is very useful.

This invention is described in greater detail with reference to the following examples, although it is not limited thereto.

PREPARATION EXAMPLE

Example of Preparation of Light-Sensitive Materials

Preparation of Light-Sensitive Material E-1

A silver iodidebromide was prepared in the following manner.

Gelatin (40 g) and 26 g of KBr were dissolved in 3,000 ml of water, and the solution was stirred while maintaining at 50° C. Then, a solution of 34 g of silver nitrate dissolved in 200 ml of water was added to the above solution for 10 minutes, and then a solution of 3.3 g of potassium iodide dissolved in 100 ml of water was added for 2 minutes. The pH of the resulting silver iodidebromide was adjusted to precipitate it, and the excess of the salt was removed. The pH was then adjusted to 6.0, and 400 g of a silver iodidebromide emulsion was obtained.

A benzotriazole silver emulsion was prepared in the following manner.

Gelatin (28 g) and 13.2 g of benzotriazole were dissolved in 3,000 ml of water, and the solution was stirred while maintaining at 40° C. A solution of 17 g of silver nitrate dissolved in 100 ml of water was added to the above solution for 2 minutes. The pH of the resulting benzotriazole silver emulsion was adjusted to precipitate it, and the excess of the salt was removed. The pH was then adjusted to 6.0, and 400 g of a benzotriazole silver emulsion was obtained.

A gelatin dispersion used a dye releasing redox compound was prepared as follows.

5 g of a magenta dye releasing redox compound (a) represented by the following formula, 0.5 g of 2-ethylhexyl succinate sodium sulfonate as a surface active agent, and 5 g of tricresyl phosphate (TCP) were added to 20 ml of ethyl acetate. The mixture was heated to about 60° C. to form a uniform solution. The solution was mixed with 100 g of a 10% solution of lime-processed gelatin with stirring. The mixture was dispersed at 10,000 rpm for 10 minutes by a homogenizer to prepare a dispersion of the magenta dye releasing redox compound (a).

Dye Releasing Redox Compound (a)

-continued

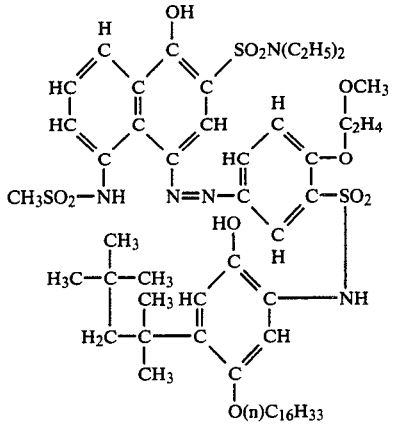

A photosensitive layer was prepared as follows:

| | | |
|---|---|---|
| (a) | Silver iodidebromide emulsion | 20 g |
| (b) | Benzotriazole silver emulsion | 10 g |
| (c) | Gelatin dispersion of the dye releasing redox compound (a) | 33 g |
| (d) | 5% aqueous solution of a compound having the following structure | 5 ml |

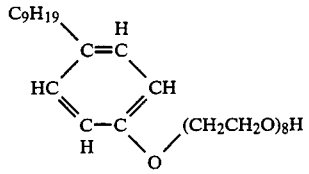

| | | |
|---|---|---|
| (e) | 10% ethanol solution of guanidine trechloroacetate | 12.5 ml |
| (f) | 10% aqueous solution of dimethylsulfamide | 4 ml |
| (g) | Water | 7.5 ml |

The ingredients (a) to (g) were mixed and heated to prepare a photosensitive coating solution. The solution was coated to a wet thickness of 30 μm on a polyethylene terephthalate film having a thickness of 180 μm.

As a protective layer, a solution obtained by the following mixing

| | | |
|---|---|---|
| (h) | 10% aqueous solution of gelatin | 35 g |
| (i) | 10% ethanol solution of guanidine trichloroacetate | 6 ml |
| (j) | 1% aqueous solution of 2-ethylhexyl succinate sodium sulfonate | 4 ml |
| (k) | Water | 55 ml |

was coated to a wet thickness of 25 μm on the photosensitive layer, and dried to prepare Photographic Material E-1.

EXAMPLE OF PREPARING DYE FIXING MATERIALS

(1) Preparation of Dye Fixing Material R-0

A hydrophilic heat solvent-containing layer having the following components was uniformly coated to a wet film thickness of 70 μm on a white polyethylene terephthalate film containing $TiO_2$ and dried.

| | | |
|---|---|---|
| (a) | Urea | 4 g |

-continued

| | |
|---|---|
| (b) Water | 8 ml |
| (c) 10% aqueous solution of polyvinyl alcohol having a degree of polymerization of 570 and a degree of saponification of 98.5% (PVA 105, produced by Kuraray Co., Ltd.) | 12 g |
| (d) 10% by weight aqueous solution of poly(methyl acrolate-co-N,N,N—trimethyl-N—vinylbenzyl ammonium chloride) (the ratio of methyl acrylate to benzyl ammonium chloride = 1:1) | 12 g |
| (e) 5% aqueous solution of the following compound | 2 ml |

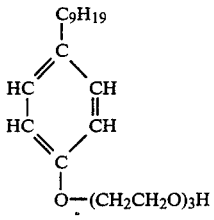

| | |
|---|---|
| (f) 5% aqueous solution of sodium dodecylbenzenesulfonate | 0.5 ml |

(2) Preparation of Dye Fixing Materials R-1 to R-8

Dye Fixing Materials R-1 to R-8 was prepared in the same way as in the preparation of R-0 except that each of the polymers shown in Table 1 was used instead of the mordant (d).

EXAMPLE 1

Light-Sensitive Material E-1 prepared as above was uniformly exposed for 10 seconds at 2,000 lux using a tungsten-filament lamp, and then heated uniformly for 20 seconds on a heat block heated at 140° C.

The light-sensitive material and each of Dye Fixing Materials R-0 to R-8 were superposed so that their coated surfaces face each other. The assembly was passed between hot rollers at 130° C. under pressure, and immediately then, heated for 45 seconds on a heat block at 120° C. Immediately after heating, each of Dye Fixing Materials R-0 to R-8 was peeled off from Light-Sensitive Material E-1. The results are shown in Table 1.

The peeling property was evaluated as follows. The light-sensitive materials and the image acceptive sheet each having an area of 100 $cm^2$ (square-shaped with each side measuring 10 cm) were peeled apart after heat transfer (for 45 seconds on a heat roller at 120° C.). The area of that portion of the surface of the image acceptive sheet to which the emulsion layer of the light-sensitive material remained adhering was then measured.

Transfer of the image was carried out at a relative humidity of 20%. Since the peeling property tends to become poor as the humidity is lower, a low humidity at which a significant adverse effect would ordinarily be obtained was selected.

TABLE 1

| Sample No. | Mordant | Area of the Adhering Emulsion ($cm^2$) |
|---|---|---|
| R-0 (Comparison) | Quaternary Ammonium Type Polymer (for Comparison)* | 100 |

TABLE 1-continued

| Sample No. | Mordant | Area of the Adhering Emulsion ($cm^2$) |
|---|---|---|
| R-1 | P-1 (Invention) | 0 |
| R-2 | P-2 (Invention) | 0 |
| R-3 | P-3 (Invention) | 0 |
| R-4 | P-4 (Invention) | 10 |
| R-5 | P-5 (Invention) | 15 |
| R-6 | P-6 (Invention) | 5 |
| R-7 | P-7 (Invention) | 0 |
| R-8 | P-8 (Invention) | 5 |

*Poly(methyl acrylate-co-N,N,N—trimethyl-N—vinyl-benzyl ammonium chloride) (the ratio of methyl acrylate to benzyl ammonium chloride = 1:1)

These results demonstrate that when the dye fixing materials of this invention are used, their peeling property from the light-sensitive material is very good.

EXAMPLE 2

The same light-sensitive material as used in Example 1 and a dye fixing material shown below were used, and the color fading resistance after atorage in dark places (the number of days required until the image density decreases to 90% of the initial density (measured immediately after the image was transferred) under the storage conditions of 60° C. and 70% RH) and the peeling property as in Example 1 were examined.

The structure of the dye fixing material used in this Example was as follows:

| | |
|---|---|
| Second Layer | |
| PVA | 3.6 $g/m^2$ |
| Mordant | 3.0 |
| Urea | 6.0 |
| N—Methylurea | 6.0 |
| First Layer | |
| Gelatin | 2.0 $g/m^2$ |
| Base Film | |
| Polyethylene terephthalate film containing $TiO_2$ | |

Further, a dye fixing material having the same structure as described above except containing 0.2 $g/m^2$ of $Zn(AcO)_2$ in the first layer was prepared.

As the mordant, each of the polymers shown in Table 2 was used, and the result obtained are shown in Table 2.

TABLE 2

| Mordant | Area of the Adhering Emulsion ($cm^2$) | Color fading Resistance (days) |
|---|---|---|
| Quaternary Ammonium Type Polymer* | 100 | 4 |
| P-1 | 0 | 5.5 |
| P-1 (containing $Zn^{++}$ in the first layer) | 0 | 7 |

*Poly(methyl acrylate-co-N,N,N—trimethyl-N—vinylbenzyl ammonium chloride) (the ratio of methyl acrylate to benzyl ammonium chloride = 1:1)

These results demonstrate that when the dye fixing materials of this invention are used, the transferred images have good color fading resistance, and especially when a mordant polymer is used in combination with a metal ion, the color fading resistance of the image is further improved.

While the invention has been described in detail and with reference to specific embodiments thereof, it will be apparent to one skilled in the art that various changes and modifications can be made therein without departing from the spirit and scope thereof.

What is claimed is:

1. A photographic element comprising a light-sensitive material and a dye fixing material for fixing a mobile hydrophilic dye formed imagewise to a dye fixing layer, said imagewise dye being formed by heating said light-sensitive material in a state containing substantially no water after or during imagewise exposure, said light-sensitive material being composed of a support and having provided thereon, at least (1) a light-sensitive silver halide, (2) a binder, (3) a compound capable of forming the mobile hydrophilic dye imagewise by being chemically related to the reaction of reducing the silver halide to silver at high temperatures, and (4) an organic silver salt oxidizing agent; and said dye fixing materials comprising at least one layer containing as a constitutent on a support a polymer having monomeric units of formula (I)

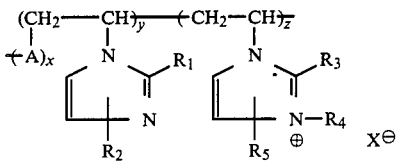

(I)

wherein A represents a vinyl monomer unit having no imidazole or imidazolium group, $R_1$ and $R_3$ respectively represent a hydrogen atom, an alkyl group, an alkyl group substituted by a group capable of forming a coordinate bond with a metal, or a salt thereof, $R_2$ and $R_5$ respectively represent a hydrogen atom or an alkyl, aralkyl, or aryl group, $R_4$ represents an alkyl or aralkyl group, $X^{63}$ represents an acid radical, x is from 10 to 80 mole%, y is from 10 to 80 mole %, z is from 0 to 10 mole % and y is not less than z.

2. A photographic element as claimed in claim 1, wherein said photographic element contains a hydrophilic thermal solvent.

3. A photographic element as claimed in claim 2, wherein the hydrophilic thermal solvent is contained in the dye fixing material.

4. A photographic element as claimed in claim 3, wherein the coating amount of the hydrophilic thermal solvent is from 20 to 200% by weight based on the total coating amount of layers of the light sensitive material.

5. The dye image forming process as in claim 1, wherein x is from 10 to 80 mole%, y is from 10 to 80 mole%, and z is 0.

6. The dye image forming process as in claim 1, wherein compound (3) capable of forming the mobile dye imagewise is selected from the group consisting of dye releasing compounds capable of releasing mobile dyes by reaction with the oxidation product of a reducing agent formed by an oxidation-reduction reaction with a silver halide which takes place by heating, couplers capable of forming mobile dyes by a coupling reaction with the oxidation product of a reducing agent formed by the oxidation-reduction reaction with a silver halide which takes place by heating, compounds having diffusion resistance which do not inherently release mobile dyes but when reduced release mobile dyes, compounds which inherently release mobile dyes when heated, but by the oxidation-reduction reaction with silver halide which occurs by heating fail to release mobile dyes, and reducible dye releasing redox compounds which release mobile dyes after they have been oxidized to oxidation products.

7. The dye image forming process as in claim 1, wherein compound (3) capable of forming the mobile dye imagewise is a dye releasing compound capable of releasing a mobile dye by reaction with the oxidation product of a reducing agent formed by an oxidation-reduction reaction with a silver halide which takes place by heating.

8. The dye image forming process as in claim 1, wherein compound (3) capable of forming the mobile dye imagewise is a coupler capable of forming a mobile dye by a coupling reaction with the oxidation product of a reducing agent formed by the oxidation-reduction reaction with a silver halide which takes place by heating.

9. The dye image forming process as in claim 1, wherein compound (3) capable of forming the mobile dye imagewise is a compound having diffusion resistance which does not inherently release a mobile dye but when reduced releases a mobile dye.

10. The dye image forming process as in claim 1, wherein compound (3) capable of forming the mobile dye imagewise is a compound which inherently release a mobile dye when heated, but by the oxidation-reduction reaction with silver halide which occurs by heating fail to release a mobile dye.

11. The dye image forming process as in claim 1, wherein compound (3) capable of forming the mobile dye imagewise is a reducible dye releasing redox compound which releases a mobile dye after it has been oxidized to oxidation products.

12. The dye image forming process as in claim 11, wherein said reducing dye releasing redox compound is represented by formula (IV)

$$Ra—SO_2—Da \quad (IV)$$

wherein Ra represents a reducing group capable of being oxidized by a silver halide; and Da represents an image forming dye portion containing a hydrophilic group.

13. A photographic element as claimed in claim 1, wherein x is from 10 to 80 mole %, y is from 10 to 80 mole %, and z is 0.

14. A process of forming an image in a light-sensitive material, comprising:

thermally developing a light-sensitive material to form a mobile dye imagewise in a state containing substantially no water after or during imagewise exposure, said light-sensitive material being composed of a support having provided thereon, at least (1) a light-sensitive silver halide, (2) a binder, and (3) a compound capable of forming the mobile dye imagewise by being chemically related to the reaction of reducing the silver halide to silver at high temperature;

heat transferring the mobile dye from said light-sensitive material to a dye fixing material after or during said developing by heating; and peeling the dye fixing material from the light-sensitive material after image transfer, said dye fixing material comprising at least one layer containing as a constituent on a support a polymer having monomeric units of formula (I)

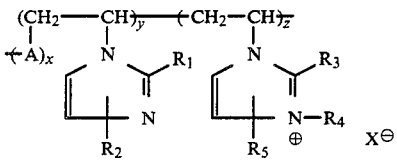

(I)

wherein A represents a vinyl monomer unit having no imidazole or imidazolium group, $R_1$ and $R_3$ respectively represent a hydrogen atom, an alkyl group, an alkyl group substituted by a group capable of forming a coordinate bond with a metal, or a salt thereof, $R_2$ and $R_5$ respectively represent a hydrogen atom or an alkyl, aralkyl, or aryl group, $R_4$ represents an alkyl or aralkyl group, $X^{\ominus}$ represents an acid radical, x is from 10 to 80 mole %, y is from 10 to 80 mole %, z is from 0 to 10 mole % and y is not less than z.

15. The dye image forming process as in claim 14, wherein said light-sensitive material contains (4) an organic silver salt oxidizing agent.

16. The process of claim 14, wherein said said step of heat transferring the mobile dye is carried out in the presence of a hydrophilic thermal solvent.

17. The process of claim 16, wherein the hydrophilic thermal solvent is incorporated in the dye fixing material.

18. The process of claim 17, wherein the coating amount of the hydrophilic thermal solvent is from 20 to 200% by weight based on the total coating amount of layers of the light sensitive materials.

19. A photographic element as claimed in claim 1, wherein compound (3) capable of forming the mobile hydrophilic dye imagewise is selected from the group consisting of dye releasing compounds capable of releasing mobile hydrophilic dyes by reaction with the oxidation product of a reducing agent formed by an oxidation-reduction reaction with a silver halide which takes place by heating, couplers capable of forming mobile hydrophilic dyes by a coupling reaction with the oxidation product of a reducing agent formed by the oxidation-reduction reaction with a silver halide which takes place by heating, compounds having diffusion resistance which do not inherently release mobile hydrophilic dyes but when reduced release mobile hydrophilic dyes, compounds which inherently release mobile hydrophilic dyes when heated, but by the oxidation-reduction reaction with silver halied which occurs by heating fail to release mobile hydrophilic dyes, and reducible dye releasing redox compounds which release mobile hydrophlic dyes after they have been oxidized to oxidization products.

20. A photographic element as claimed in claim 1, wherein compound (3) capable of forming the mobile hydrophilic dye imagewise is a reducible dye releasing redox compound which releases a mobile dye after it has been oxidized to oxidation products represented by formula (IV)

$$Ra—S0_2—Da \qquad (IV)$$

wherein Ra represents a reducing group capable of being oxidized by a silver halide; and Da represents an image forming dye portion containing a hydrophilic group.

* * * * *